US006620470B2

(12) United States Patent
Nojima et al.

(10) Patent No.: US 6,620,470 B2
(45) Date of Patent: Sep. 16, 2003

(54) INK JET RECORDING MEDIA

(75) Inventors: Takahiko Nojima, Tokyo (JP); Keiji Ohbayashi, Tokyo (JP)

(73) Assignee: Konica Corporation, Tokyo (JP)

( * ) Notice: Subject to any disclaimer, the term of this patent is extended or adjusted under 35 U.S.C. 154(b) by 24 days.

(21) Appl. No.: 09/942,071

(22) Filed: Aug. 28, 2001

(65) Prior Publication Data

US 2002/0045035 A1 Apr. 18, 2002

(30) Foreign Application Priority Data

Aug. 31, 2000 (JP) ..... 2000-262970

(51) Int. Cl.[7] ..... B41M 5/00
(52) U.S. Cl. ..... 428/32.34
(58) Field of Search ..... 428/195, 32.34; 347/105

(56) References Cited

U.S. PATENT DOCUMENTS 6,165,606 A * 12/2000 Kasahara et al. ..... 428/323
6,503,604 B1 * 1/2003 Kasahara et al. ..... 428/195

FOREIGN PATENT DOCUMENTS

WO WO 99/64248 12/1999

OTHER PUBLICATIONS

*Paper and Board—Determination of Water Absorptiveness—Cobb Method*, Japanese Industrial Standard, JIS P 8140: 1998.

*Paper and Board—Determination of Water Absorptiveness—Cobb Method*, International Standard, ISO 535, 2nd Ed., Jan. 7, 1991.

*Method for Determining the Liquid Absorbability of Paper and Board (Bristow's Method)*, J. Tappi Paper and Pulp Test Method No. 51 (J. Tappi No. 51).

* cited by examiner

*Primary Examiner*—B. Hamilton Hess
(74) *Attorney, Agent, or Firm*—Squire, Sanders & Dempsey, L.L.P.

(57) ABSTRACT

The present invention is to provide a ink-jet recording sheet of high ink absorptive property, high cockling resistance, high surface smoothness, low cost, and high image quality with incorporating specially designed void-forming absorptive layer whose absorptiveness is determined by a ratio of a Bristow Test value and a Cobb value.

22 Claims, No Drawings

INK JET RECORDING MEDIA

FIELD OF THE INVENTION

The present invention relates to an ink-jet recording sheet which is capable of producing a print of photo-grade quality, and particularly relates to an ink-jet recording sheet which has high ink absorbance and yields a high quality print of high cockling resistance, high bleeding resistance, and high image density.

BACKGROUND OF THE INVENTION

Ink-jet recording methods, which is also called a recording method hereafter, are carried out by impinging micro-droplets employing various working principles and placing them onto a recording sheet to record images, text characters, and exhibits advantages such as relatively high speed, low noise, easy preparation of multicolor images. Regarding this method, conventional problems with nozzle clogging and maintenance have been overcome by improvements in both aspects of ink and instrument, and currently, it is being increasingly employed in various fields such as printers, facsimile machines, and computer terminals.

Ink-jet recording sheets, which are also called a recording sheet hereafter, employed in ink-jet recording methods have generally needed to meet requirements such as the density of printed dots to be high and the hue to be bright and clear; ink needs to be quickly absorbed and when printed dots are superimposed, ink neither is to flow nor spread; diffusion of the printed dots in the horizontal direction is not larger than required and the border is smooth and results in sharpness.

Specifically, at low rates of ink absorption on a recording sheet when recording is carried out by superimposing at least two color ink droplets, previous droplets result in repellence to cause density unevenness, and in the boundary area of different colors, different color inks blend with each other. As a result, image quality tends to be markedly degraded. Therefore, it is required that the recording sheets exhibit high ink absorbability.

In order to overcome these problems, as is common, a great number of techniques have been proposed.

For example, Japanese Patent Publication Open to Public Inspection No. 52-53012 describes a recording sheet in which minimally sized paper is damped with paint employed for surface treatment; Japanese Patent Publication Open to Public Inspection No. 55-5830 describes a recording sheet comprising a support on the surface of which is provided an ink-absorbable coating layer; Japanese Patent Publication Open to Public Inspection No. 56-157 describes a recording sheet comprising a covering layer containing non-colloidal silica powder as a pigment; Japanese Patent Publication Open to Public Inspection No. 57-107873 describes a recording sheet comprising an inorganic pigment and an organic pigment in combination; Japanese Patent Publication Open to Public Inspection No. 58-110287 describes a recording sheet which exhibits a two peak void distribution; Japanese Patent Publication Open to Public Inspection No. 62-111782 describes a recording sheet composed of an upper porous layer and a lower porous layer; Japanese Patent Publication Open to Public Inspection Nos. 59-68292, 59-123696, 60-18383, and others describe a recording sheet featuring amorphous cracking; Japanese Patent Publication Open to Public Inspection No. 61-135786 and others describe a recording sheet having a fine powder layer; Japanese Patent Publication Open to Public Inspection Nos. 63-252779, 1-108083, 2-136279, 3-65376, 3-27976, and others describe a recording sheet comprising pigments and fine silica particles having specified physical parameters; Japanese Patent Publication Open to Public Inspection Nos. 57-14091, 60-219083, 60-210984, 61-20797, 61-188183, 5-278324, 6-92011, 6-183134, 7-137431, 7-276789, and others describe a recording sheet containing fine silica particles such as colloidal silica; Japanese Patent Publication Open to Public Inspection Nos. 2-276671, 3-67684, 3-215082, 3-251488, 4-67986, 4-263983, 5-16517, and others describe a recording sheet containing fine hydrated alumina particles.

As the ink-jet recording sheet, various kinds of ink-jet recording sheets have been employed. For example, there have been employed ordinary paper, various coated papers (art paper, coated paper, cast-coated paper, etc.) prepared by coating a layer comprising a hydrophilic binder and an inorganic pigment on a paper support. Furthermore, there have been employed recording sheets prepared by coating an ink absorptive layer as a recording layer on various supports such as the above-mentioned papers, various kinds of transparent or opaque plastic film supports, or various supports prepared by covering both sides of paper sheets with a plastic resin.

The above-mentioned ink absorptive layer is divided into two main groups, that is, one is a so-called swelling-type ink absorptive layer composed mainly of a hydrophilic binder, and the other is a void-type ink absorptive layer having a layer of voids in the recording layer.

The advantages of the swelling-type ink absorptive layer are that after an ink solvent (water or a high boiling point solvent) is completely vaporized, remarkably high glossiness and high density are obtained. On the other hand, the ink-absorbing rate is smaller than that of the void type recording sheet mentioned above and described below, and there is also a problem in which in a high ink density region, image quality tends to be deteriorated due to the formation of roughness caused by beading. Furthermore, vaporization of an ink solvent, especially a high boiling point organic solvent, is extremely slow and after printing, the high boiling point organic solvent remains in the hydrophilic binder for some time. Thus, there is a problem in which the hydrophilic binder is under a swelled and wet state for a fairly long period of time.

As a matter of fact, for several hours after printing, in some cases, for several days after printing, the situation is that it is impossible to rub the printed surface strongly or to stack the printed sheets of paper.

On the other hand, the void type ink absorptive layer, having voids in the recording layer, results in great ink absorptivity. Accordingly, as compared to the swelling-type, there is negligible image beading in the high ink density area and degradation of the image quality in the high density area is minimal.

Furthermore, when the void type ink absorptive layer has a sufficient void volume, compared to that of the ink, immediately after printing, the surface acts as if dried, even though the organic solvent remains in the void structure. Thus, it is possible to touch the surface and to have printed sheets be in contact with.

For this type of ink absorptive layer, fine particles having a low refractive index (a refractive index of 1.6) and a small diameter (200 nm or less) are preferably employed because they form a relatively highly transparent layer. Of the particles, fine particle silica which satisfies such conditions is particularly preferably employed, since it efficiently forms voids, and further, results in relatively high glossiness and images having high maximum density.

The ink-jet recording sheet comprising a support having thereon the above-mentioned void type ink absorptive layer is excellent, resulting in particularly high glossiness, a high void ratio and high maximum density. In addition, when a support having relatively good flatness is employed, a ink-jet recording sheet having a high glossy surface is obtained.

Of these, ink-jet recording sheets having many voids for absorbing or keeping ink in the ink absorptive layer, show high ink absorbance and low bleeding at the border of the image. As a result, images of high quality can be produced.

However, the amount of ink absorbed in the void-type ink absorptive layer is limited, because the effective volume used for incorporating ink is limited by the presence of void forming material. This situation can be understood by an example: When a void-type ink absorptive layer of a dry thickness 40 $\mu$m is formed by using a 22 $\mu$m material, the maximum void volume per $m^2$ can be calculated as follows; $0.0001\times(40-22)(cm)\times10000(cm^2)=18$ ml. The required void volume depends on the image forming methods employed. However, a lack of ink absorbing volume may result in the maximum ink receiving region. When the ink absorbing volume is insufficient, the ink is partly bleed out, and consequently the image quality is greatly deteriorated.

When a void-type ink absorptive layer is provided on a non water-absorptive support, an image of high dye density can be obtained. However, it is essential to load a large amount of ink absorptive material in order to achieve a sufficient amount of ink absorbance, resulting in a thick dried layer. In that case, due to the void structure of the layer, the layer tends to be brittle, especially in a dry and low temperature condition. In addition, the recording sheet using the non water-absorptive support is generally rather expensive.

In order to obtain ink jet prints close in quality to silver halide photographic prints, a recording method using water-soluble dyes is commonly employed. These dyes are generally used with fixing agents to prevent diffusion of dyes and bleeding of formed images during storage. The fixing property differs depending on the combination of fixing agents and dyes. Moreover, the diffusion of dyes is likely to be accelerated due to the hygroscopicity of the high boiling point organic solvent used in the ink. Therefore, it is seldom recognized that the ink-jet prints are comparable with current photographic prints in terms of bleeding resistance.

Ink-jet recording sheets provided with a void-type ink absorptive layer on a non water-absorptive support are considered to be suitable for producing photo-grade prints, which are particularly demanded for an application of ink-jet recording in recent years. Recently, many attempts have been made to more approximate the image quality of ink-jet prints to that of photographic prints.

Of these attempts, one of the most important factors to improve image quality is to make image forming dots indistinguishable. For that purpose, it is preferable to supply smaller ink droplets, or to use lower density color ink together with normal density color ink in order to decrease the reflection density of dots, especially in the highlight regions and to make the distinction of individual dots more difficult.

The ink volume needed for making high quality prints is increased due to using the low density color ink. Consequently, the ink absorptive capacity of a recording sheet tends to be insufficient. This will cause bleeding of ink which decreases image quality and extends the drying time. When the thickness of the void-type ink absorptive layer is increased, cracking may appear due to the characteristics of the layer. The coating speed during manufacturing must be retarded to dry the layer, which would increase cost.

On the other hand, when a void-type ink absorptive layer is provided on a water-absorptive support, the support itself has a high absorbing capacity, and consequently absorbs much ink. This property is preferable from the view of ink absorption, and the thickness of the dried ink absorptive layer can be decreased more than in the case with non water-absorptive supports.

When ordinary paper, high quality paper, coated paper, or cast-coated paper is used for a recording sheet, the ink penetrates into the paper support. This is favorable for ink absorption and bleeding resistance. But the surface of the recording sheet tends to wrinkle due to the absorption and drying of the ink in printed areas, which will cause deterioration of image quality and reduction of glossiness. The maximum density tends to decrease due to the penetration of the dye into the support, and high definition images are hard to achieve with this type of support. Specifically, recording sheets provided with an ink absorptive layer on the water-absorptive support tends to produce a cockling which occurs on the surface of the sheet due to shrinkage of the printed ink, and the surface smoothness becomes non-uniform between printed areas and non printed areas, which is of course not preferable for high image quality. It is difficult to satisfy ink absorbance, bleeding resistance, and cockling resistance simultaneously.

A technology to provide a barrier layer to prevent penetration of ink into a support is proposed. Japanese Patent Publication Open to Public Inspection No. 10-46498 describes a technology to provide a water proofing property for the support in order to prevent the shrinkage of the support even after penetration of the ink. But by applying these technologies, the amount of absorbed ink decreases and the problem of bleeding tends to occur, and as a result, high quality images cannot be obtained.

Japanese Patent Publication Open to Public Inspection No. 5-51470 describes a technology to provide a porous layer, which can absorb liquid of more than 1 $ml/m^2$, between the support and the ink absorptive layer, and the ink absorptive layer being comprised of beaded colloidal silica, a specific grafted polymer, and a latex polymer. This formulation allows closer contact of the support to the ink absorptive layer, improves water proofing property and higher printed image quality. However, the effect produced by using a water-absorptive support of the present invention was not disclosed in that patent.

Japanese Patent Publication Open to Public Inspection No. 5-85053 describes a technology to decrease surface roughness of recording sheets by providing an interlayer comprising an adhesive compound whose glass transition point is 30 to 60° C. and pigments between the normal absorptive support and the ink absorptive layer.

Japanese Patent Publication Open to Public Inspection No. 8-300806 describes a technology to decrease abrasion of the recording sheet in the course of transportation in the printer and thus improve ink absorbance. This can be achieved by providing an anchor layer composed of an self-adhesive pigment between the wood pulp support and the ink absorptive layer. However, these technologies are insufficient to achieve the effect of the present invention.

Japanese Patent Publication Open to Public Inspection No. 11-78214 describes a technology to decrease wrinkling of the printed portion of the recording sheet which yields a similar appearance to a photographic print. This can be achieved by providing an appropriate Cobb value using an aqueous solution containing 30 weight % of ethylene glycol to an ink-jet recording sheet provided with a void-type ink absorptive layer having fine particles, the average particle diameter being less than 100 nm on a water-absorptive support. After exhaustive experimentation by the present inventors, it was demonstrated that this technology is also insufficient to obtain the effect of the present invention.

SUMMARY OF THE INVENTION

The present invention was done to overcome the problems described above. The object of the present invention is to provide an ink-jet recording sheet which has excellent ink absorptive property, high cockling resistance, high surface smoothness, low cost, and high image quality with a relatively thin ink absorptive layer.

An object of the present invention can be achieved by the following compositions.

1. An ink-jet recording sheet, comprising:
   (i) a support which is capable of absorbing water; and
   (ii) an ink absorptive layer, which has a void structure, including;
      (a) a first hydrophilic binder; and
      (b) inorganic particles having an average diameter of 3 to 200 nm;
      wherein the ink-jet recording sheet has a $Q_1$, value of 15 to 35, and a $Q_1/Q_2$ value of 0.3 to 0.7;
      the $Q_1$ value being a Bristow Test value (ml/m$^2$) which is derived from a first transferred amount of a mixture solution of diethylene glycol/trietylene glycol monobutylether/water, at a respective weight ratio of 15:15:70, being in contact with a surface of the ink absorptive layer for 1.0 second; and the $Q_2$ being a Cobb value (g/m$^2$), and derived from a second transferred amount of the mixture solution in contact with the surface of the ink absorptive layer for 60 seconds.

The Cobb value can be measured with a method described in JIS P8140, which is based on ISO 535, and the essential measuring method is described in ISO 535.

2. The ink-jet recording sheet of item 1 wherein an amount of the ink absorptive layer is 7 to 30 g/m$^2$.

3. The ink-jet recording sheet of item 1 wherein the ink absorptive layer contains a cationic polymer or cationic particles.

4. The ink-jet recording sheet of item 1, wherein the support includes a gelling agent which is capable of gelling a coating composition forming the ink absorptive layer.

5. The ink-jet recording sheet of item 1, wherein the $Q_1$ value is 20 to 30 ml/m$^2$.

6. The ink-jet recording sheet of item 1, wherein the inorganic particles are at least one of silica, colloidal silica, calcium silicate, calcium carbonate, boehmite, aluminum hydroxide and hydrate of aluminum hydroxide.

7. The ink-jet recording sheet of item 6, wherein the inorganic particles are silica.

8. The ink-jet recording sheet of item 1, wherein the hydrophilic binder is polyvinyl alcohol.

9. The ink-jet recording sheet of item 1, wherein the weight ratio of the inorganic particles to the first hydrophilic binder is not less than 3.

10. The ink-jet recording sheet of item 5, wherein the ink absorptive layer includes a gelling agent which is capable of gelling the ink absorptive layer.

11. The ink-jet recording sheet of item 10, wherein the gelling agent is boric acid or a salt of boric acid.

12. The ink-jet recording sheet of item 10, wherein the amount of the gelling agent is 1 to 200 mg per gram of the first hydrophilic binder.

13. The ink-jet recording sheet of item 1 which further comprises an interlayer including a second hydrophilic binder between the support and the ink absorptive layer.

14. The ink-jet recording sheet of item 13, wherein the interlayer has a void structure containing particles of an average diameter of 3 to 1000 nm.

15. The ink-jet recording sheet of item 13, wherein the amount of the second hydrophilic binder is 0.01 to 5 g/m$^2$.

16. The ink-jet recording sheet of item 15, wherein the second hydrophilic binder is gelatin or polyvinyl alcohol.

17. The ink-jet recording sheet of item 6, wherein the hydrophilic binder is polyvinyl alcohol and the ink absorptive layer further contains a gelling agent.

18. The ink-jet recording sheet of item 17 which further comprises an interlayer including a second hydrophilic binder between the support and the ink absorptive layer, wherein the weight ratio of the inorganic particles to the first hydrophilic binder is not less than 3, and the gelling agent is boric acid or a salt of boric acid whose amount is 1 to 200 mg per gram of the first hydrophilic binder.

19. The ink-jet recording sheet of item 14, wherein the inorganic particles are colloidal silica.

20. A multi-layered ink-jet recording sheet, comprising:
   (i) a support which is capable of absorbing water;
   (ii) an ink absorptive layer which has a void structure including;
      (a) a first hydrophilic binder; and
      (b) inorganic particles having an average diameter of 3 to 200 nm; and
   (iii) an interlayer between the support and the ink absorptive layer, which contains a second hydrophilic binder;
      wherein the ink-jet recording sheet has a $Q_1$ value of 15 to 35, and a $Q_1/Q_2$ value of 0.3 to 0.7;
      the $Q_1$ value being a Bristow Test value (ml/m$^2$) which is derived from a first transferred amount of a mixture solution of diethylene glycol/trietylene glycol monobutylether/water, at a respective weight ratio of 15:15:70, being in contact with a surface of the ink absorptive layer for 1.0 second; while the $Q_2$ being a Cobb value (g/m$^2$), defined by JIS P 8140, and derived from a second transferred amount of the mixture solution in contact with the surface of the ink absorptive layer for 60 seconds.

21. The ink-jet recording sheet of item 1, comprising an interlayer containing boric acid or a salt of boric acid between the support and the ink absorptive layer.

22. The ink-jet recording sheet of item 1, comprising an interlayer between the support and the ink absorptive layer, wherein the interlayer contains a self-cross linking resin or a colloidal silica composite.

DETAILED DESCRIPTION OF THE INVENTION

The present invention is detailed below.

The ink-jet recording sheet of the present invention preferably has a $Q_1$ value of 15 to 35 g/m$^2$, and more preferably a $Q_1$ value of 20 to 30 g/m$^2$ in order to achieve the object of the invention. The $Q_1$ values are obtained by the Bristow Test method, which is derived by measuring a transferred volume of a mixture solution of diethylene glycol/trietylene glycol monobutylether/water, at a respective weight ratio of 15:15:70, being in contact with the surface of the ink absorptive layer for 1.0 second.

Cobb value $Q_2$ is water absorptiveness and defined by JIS P8140 (1998). The surface of the ink absorptive layer is contacted with the mixture solution for 60 seconds and the transferred amount is designated as the $Q_2$ value (g/m$^2$). The composition of the mixture solution is the same as used for measuring the $Q_1$ value (ml/m$^2$); diethylene glycol/trietylene glycol monobutylether/water, at a respective weight ratio of 15:15:70. The preferable $Q_1/Q_2$ value of the present invention is 0.3 to 0.7. More preferable $Q_1/Q_2$ value is 0.6 to 0.7.

When the $Q_1/Q_2$ value is more than 0.7, the penetration of the solvent contained in ink-jet printing ink into the water absorptive support through the ink absorptive layer is difficult, and the solvent tends to remain in the ink absorptive layer, resulting in deteriorating the bleeding resistance. While the $Q_1/Q_2$ value is less than 0.3, the penetration of the solvent contained in ink-jet printing ink into the water absorptive support through the ink absorptive layer is easily carried out, resulting in deteriorating the cockling property. As a result, in order to achieve the desired effects of the present invention, it is essential to have the $Q_1/Q_2$ value of 0.3 to 0.7.

The solution used for measuring the transferred amount in the Bristow Test is a mixture of diethylene glycol/trietylene glycol monobutylether/water, at a respective weight ratio of 15:15:70. When a different mixture solution, for example, a mixture of diethylene glycol/water, at a weight ratio of 30:70, is employed, the recording sheet exhibits a different absorbance value. As a result, an accurate composition, which gives the effect of the present invention, cannot be identified.

The water-absorptive support used for the ink-jet recording sheet of the present invention is identified using a water absorptiveness test defined in JIS P8140. The test is carried out by using a mixture solution of diethylene glycol/trietylene glycol monobutylether/water, at a respective weight ratio of 15:15:70, and limiting the contact time to 10 seconds. The obtained Cobb value of the present invention is preferably 10 to 50 g/m$^2$, and more preferably 20 to 40 g/m$^2$. When the Cobb value is 10 to 50 g/m$^2$, the ink is completely absorbed in the water-absorptive support. Thus bleeding of the ink can be prevented and a high quality printed image tends to be obtained. In addition, this range of Cobb value is preferable since it tends to prevent cracking of the coated layer in the drying process during manufacturing.

The recording sheets having $Q_1/Q_2$ value of the present invention can be prepared by various methods. Examples of such methods are selected from the methods by changing the kinds and amount of the additives to the non-water absorptive supports, and by adjusting the kinds and amount of inorganic fine particles and hydrophilic binders in the ink absorptive layer, or the methods described in items 4 through 5. But the present invention is not limited to these.

The water-absorptive support used for the ink-jet recording sheet of the present invention can be selected from ordinary paper, synthetic paper, cloth, a sheet made of wood and other materials, and wooden plate. Ordinary paper is especially preferable due to its high water-absorbance and low cost. The paper support of the present invention is further detailed below.

A raw material used for a paper support contains chemical pulp such as LBKP and NBKP, mechanical pulp such as GP, CGP, RMP, TMP, CTMP, CMP, and PGW, recycled paper pulp such as DIP. The above-mentioned wood pulp can be used as a major component, and further it is preferable to use hardwood pulp. As the hardwood pulp, used can be kraft pulp, sulfite pulp, chemithermomechanical pulp, or chemimechanical pulp. These can be used singly or by mixing with each other. When required, various kinds of fibrous material such as synthetic pulp, synthetic fibers or inorganic fibers can also be used as a raw material.

In order to improve whiteness of the paper, it is preferable to apply bleaching using peroxide or the like. The bleaching is preferably carried out after the following process:

Pulp is initially digested, then treated with chlorine and alkaline. Then, after being extracted or purified, it is bleached with hypochlorite or chlorine dioxide, or is bleached in multiple steps by combining these materials. Further, if desired, it can be reductively bleached with hydrosulfite or sodium boron hydride.

It is further preferred to carry out alkaline peroxide bleaching as a final pulp bleaching step of conventionally known bleached pulp. Alkaline treatment, extraction, or purification may be further carried out.

It is possible to add conventionally known additives to the raw paper. Such additives include sizing agents, white pigments, paper-strengthening agents, fixing agents, fluorescent brightening agents, moisture-holding agents, and softening agents. More specifically the following compounds may be used but the present invention is not limited to these.

The sizing agents may be compounds such as a higher fatty acid or alkylketene dimer, rosin, paraffin wax, alkenyl succinic acid, emulsion of petroleum resin;

the white pigments may be compounds such as calcium carbonate, talc or titanium oxide, fine particles of urea resin;

the paper-strengthening agents may be compounds such as starch, polyacrylamide or polyvinyl alcohol;

the fixing agents may be compounds such as aluminum sulfate or cationic polymer electrolyte.

The paper support can be manufactured with conventional paper making equipment such as a Fourdrinier machine, a cylinder machine, and a twin wire machine after applying several kinds of additives to the above-mentioned fibers, such as wood pulp. The paper support may be size-pressed with starch or polyvinyl alcohol during or after manufacture as required. Several types of coatings or calender treatments may also be conducted.

The density of the paper is generally between 0.7 and 1.2 g/m$^2$, which is specified in JIS P8118. Furthermore, the rigidity of the Base Paper is preferably between 20 and 200 g, under conditions specified in JIS-P-8143.

The pH of the paper support, when measured employing the hot water extraction method specified in JIS-P-8113, is preferably between 5 and 9.

For the purpose of increasing the adhesion strength between the support and the recording layer, and prior to coating of the recording layer, it is preferable that the support be subjected to corona discharge processing, subbing processing or interlayer coating.

The water-absorptive support of the present invention is preferably provided with at least one void-type recording layer containing hydrophilic binders and inorganic fine particles, at an average diameter of 3 to 200 nm.

When inorganic fine particles, at an average diameter of more than 200 nm, are used, the glossiness of the recording sheet or the circularity of the dot after ink-jet recording may be degraded. Further, unwanted expansion of ink dots may occur or the maximum density may be decreased due to diffused reflection light, which may cause deterioration of the sharpness of images. As a result, the object of the present invention cannot be achieved.

In order to effectively achieve the object of the present invention, the average diameter of above-mentioned inorganic particles is preferably between 3 to 100 nm. The inorganic particles may be dispersed in a binder as primary particles or may be dispersed as secondary aggregation particles, with the secondary aggregation particles being more preferable.

When inorganic particles of the secondary aggregation state are employed, the average diameter of the primary particles is preferably less than 30 nm, when considering the glossiness.

The lowest value of the average particle size of primary particles is not particularly limited, it is normally 3 nm or more, and is more preferably 6 nm or more from the viewpoint of manufacture of the particles.

The average particle size of inorganic fine particles is obtained as a simple average value (the number average) of particle sizes of 100 arbitrary particles which are obtained by observing the particles themselves, or sections or surfaces of void-containing layers. In this case, the individual particle size is represented by the diameter of an assumed circle which is the same in terms of area as the projected area of the particle.

The coating amount of the ink absorptive layer is determined by the intrinsic void ratio of the layer or required void volume. It is preferable that the solid coating amount of the ink absorptive layer in the ink-jet recording sheet of the present invention be 7 to 300 g/m$^2$. When the amount is in the range, the image properties are preferable in view of cockling, glossiness, and maximum density. In addition, the formation of layer cracking can be decreased during shrinkage of the layer in the drying process after coating of the void layer. Furthermore, the drying load is relatively small and productivity is high, which results in lowering cost.

Examples of inorganic particles employed in the ink absorptive layer are, for example, white pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

The inorganic particles as described in the present invention include both inorganic particles, having an anionic property on the surface, which do not exhibit fixability property with respect to dyes, and those having a cationic property on the surface which do exhibit fixability with respect to dyes.

When inorganic particles, having an anionic property on their surface, are employed, it is preferable to use cationic polymers with them. It is thought that the cationic polymers adhere onto their surface of the inorganic particles and are thus immobilized. And further, the ink dyes are caught and fixed by the immobilized cationic polymers.

Preferable inorganic particles are the ones whose surfaces are cationic and have fixing property to dyes. Such inorganic fine particles are selected from cationic surface treated silica made with dry method, cationic surface treated colloidal silica, alumina, colloidal alumina, pseudo-boehmite. And other inorganic particles which are described in Japanese Patent Publication Open to Public Inspection No. 8-34160 can also be used. Disclosed in this publication are inorganic particles whose surfaces are coupled with silane coupling agents having a quaternary ammonium salt and the surface potentials are changed to cationic potentials.

As inorganic fine particles, inorganic fine particles having a low index of refraction and a small particle size are preferable. Examples are silica, colloidal silica, calcium silicate, calcium carbonate, boehmite aluminum or its hydrate, from all of which silica fine particles are preferable.

When inorganic fine particles are made with dry method, the average diameter of their primary particle is preferably 6 to 20 nm.

Fine silica particles are classified in terms of manufacturing method into those made via a dry method and those made via a wet method. As fine particle silica made by a dry method, known are those made via hydrolysis in a gas phase method of silicon halide at high temperature, and those obtained by heating, reducing and evaporating siliceous sand and coke in an electric furnace through an arc method and by oxidation in ambient air. On the other hand, silica made by a wet method is obtained by generating active silica through acid decomposition of a silicate and then by polymerizing it properly by aggregation and precipitation.

Among the silica fine particles in this invention, fine particle silica synthesized through a gas phase method, in particular, is preferable.

Fine silica particles synthesized through a gas phase method are obtained by heating silicon tetrachloride with oxygen and hydrogen at high temperature. The average diameter of the primary particles is 5 to 500 nm. Particles having an average particle size of not more than 30 nm as primary particles are preferable due to yielding the recording sheets of high glossiness.

Several types of silica particles, synthesized through a gas phase method, are commercially available from Nihon Aerosil Kogyo Co., Ltd.

Colloidal silica particles preferably used in the present invention are obtained through complex acidic decomposition of sodium silicate or heating and digestion of silica sol, which is produced by passing sodium silicate through an ion-exchange resin. Application of colloidal silica particles to the ink-jet recording sheet is conventionally known. Examples of such disclosures are Japanese Patent Publication Open to Public Inspection Nos. 57-14091, 60-219083, 60-219084, 61-20792, 61-188183, 63-17807 4-93284, 5-278324, 6-92011, 6-183134, 6-297830, 7-81214 7-101142, 7-179029, 7-137431, and World Patent Publication WO 94/26530.

The average diameter of the colloidal silica is preferably 5 to 100 nm, and is more preferably 7 to 30 nm.

Colloidal silica particles and silica particles synthesized through a gas phase method may be modified with cations on their surface, and they may be treated with $Al^{3+}$, $Ca^{2+}$, $Mg^{2+}$, or $Ba^{2+}$.

The ink-jet recording sheet of the present invention includes inorganic fine particles and an ink absorptive layer featuring a void-structure. In order to form voids in the presence of the inorganic fine particles, it is essential to comprise a hydrophilic binder in the ink absorptive layer.

Examples of hydrophilic binders to be comprised in the ink absorptive layer are polyvinyl alcohol, gelatin, polyethyleneoxide, polyvinylpyrrolidone, polyacrilic acid, polyacrylamide, polyurethane, dextran, dextrin, carrageenan ($\lambda$, $\iota$), agar, pullulan, water-soluble polyvinylbutyral, hydroxyethylcellulose, and carboxymethylcellulose. These can be used singly or mixed.

Of these binders, polyvinyl alcohols are particularly preferred. Polyvinyl alcohols used for the present invention include modified polyvinyl alcohols whose terminals are modified with cations or anions, in addition to usual polyvinyl alcohols obtained from saponification of polyvinyl acetate.

Of these, polyvinyl alcohol or its derivatives, preferably employed are those having an average degree of polymerization of 1,000 or more, and particularly of 1,500 to 5,000.

Furthermore, the degree of saponification ranges preferably from 70 to 100%, and most preferably ranges from 80 to 99.5%.

Cation-modified polyvinyl alcohols include those having primary, secondary, tertiary, or quaternary amino groups in their principal chains or side chains, which are disclosed, for example, in Japanese Patent Publication Open to Public Inspection No. 61-10483.

The cation-modified polyvinyl alcohol can be prepared by saponifying a copolymer of an ethylenic unsaturated monomer, having a cationic group, with vinyl acetate.

The ethylenic unsaturated monomers having a cationic group include, for example, trimethyl-(2-acrylamide-2,2-dimethylethyl)ammonium chloride, trimethyl-(3-acrylamide-3,3-dimethylpropyl)ammonium chloride, N-vinylimdazole, N-vinyl-2-methylimidazole, N-(3-dimethylaminopropyl)methacrylamide, hydroxylethyltrimethylammonium chloride, trimethyl(methacrylamidopropyl) ammonium chloride, and N-(1,1-dimethyl-3-dimethylaminopropyl)acrylamide.

The ratio of the monomer, comprising the cation-modified group in the cation-modified polyvinyl alcohol, to the vinyl acetate, ranges preferably from 0.1 to 10 mole percent, and more preferably from 0.2 to 5 mole percent.

The anion-modified polyvinyl alcohol includes, for example, polyvinyl alcohol comprising an anionic group such as described in Japanese Patent Publication Open to Public Inspection No. 1-206088, copolymers of vinyl alcohol with a vinyl compound having a water-soluble group as described in Japanese Patent Publication Open to Public Inspection Nos. 61-237681, 63-307979, and modified polyvinyl alcohol having a water-soluble group as described in Japanese Patent Publication Open to Public Inspection No. 7-285265.

The nonion-modified polyvinyl alcohol includes, for example, polyvinyl derivatives in which a polyalkylene oxide group is added to a part of the polyvinyl alcohol as described in Japanese Patent Publication Open to Public Inspection No. 7-9758, and block copolymers of a vinyl compound having a hydrophobic group with vinyl alcohol described in Japanese Patent Publication Open to Public Inspection No. 8-25795.

Two or more kinds of hydrophilic binders may be employed in combination.

The weight ratio of the inorganic fine particles to the hydrophilic binder in the void layer of the recording sheet of the present invention should be at least 3:1 in order to achieve the desired high void ratio and strong layer structure. When the ratio is not less than 3:1, a high void ratio capable of absorbing sufficient amount of ink can be achieved, and in addition, high strength of the coated layer after ink-jet recording can also be achieved. By considering these features, the more preferable ratio of the inorganic fine particles to the hydrophilic binder is not less than 5:1.

In the course of drying the coated void containing layer, the layer shrinks. And when the rigidity of the layer is too high, minor cracking may occur in the part of the layer caused by the minor unevenness of the surface. To avoid this shortcoming, the upper limit of the weight ratio of the inorganic fine particles to the hydrophilic binder, in the void layer of the recording sheet of the present invention, is usually not more than 8.

Void Ratio

The above-mentioned void volume is the value obtained by substituting the total volume of the binder and various solid additives from the dry volume of the void-forming layer. For instance, when a void layer composes inorganic fine particles of 6 g/m$^2$ (at a specific gravity of 2.0), a hydrophilic binder of 1 g/m$^2$ (at a specific gravity of 1.0), and a cationic polymer mordant 1 g/m$^2$ (at a specific gravity of 1.0) and its dry thickness is 10 $\mu$m, then the void volume is calculated to be 5 ml/m$^2$, according the following equation.

$$10-(6/2.0)-(1/1.0)-(1/1.0)=5$$

The ink-absorptive layer of the present invention can include a gelling agent. Preferable gelling agents used for the present invention are boric acid and its salts. But other conventionally known gelling agents may also be employed. Gelling agents, which are also called simply as hardeners, are compounds having functional groups which react with hydrophilic binders, or accelerate the reaction of different functional groups of the hydrophilic binders. They may be selected according the properties of the specific binder. Examples of gelling agents are, for example, epoxy based hardeners (diglycidylethylether, ethylene glycol diglycidylether, 1,4-butanediol diglycidylether, 1,6-diglycidycyclohexane, N,N-diglycidy-4-glycidyloxyaniline, sorbitolpolydiglycidyether, and glycerolpolydiglycidyether); aldehyde based hardeners (formalin, glyoxal); active halogen based hardeners (2,4-dichloro-4-hydroxy-1,3,5-s-triazine); active vinyl based hardeners (1,3,5-trisacryloyl-hexahydro-s-triazine, bisvinylsulfonylmethylether); and aluminum alum.

Boric acids and salts thereof include oxygen acids having a boron atom as a central atom and salts thereof, and specifically, orthoboric acid, diboric acid, metaboric acid, tetraboric acid, pentaboric acid, octaboric acid, and salts thereof.

Boric acids and salts thereof exhibiting hardening properties may be used in an aqueous solution singly or by mixing with more than two compounds. Most preferred is an aqueous solution of boric acid and borax.

Separately employing boric acid and borax can only be added as a dilute aqueous solution. But when they are used in a mixed state, a more concentrated solution can be used, and the coating composition can be more concentrated. In addition, pH of the aqueous solution can be relatively easily adjusted by using a combination of the two.

The preferred amount of the above-mentioned hardeners is 1 to 200 mg per g of hydrophilic binder, while the more preferred amount is 2 to 100 mg.

When fine particles having anions on their surface are used in the ink absorptive layer of the recording sheet, a cationic polymer having a tertiary amino group or a quaternary ammonium salt group, which can be utilized to fix dyes, is preferably added. These tend to enhance the water resistance and general moisture resistance of the dye.

Conventionally known polymers may be used as cationic polymers. Examples of such cationic polymers are, for example, polyethyleneimine, polyallylamine, dicyandiamidopolyalkylenepolyamine, condensed compounds of dialkylamine with epichlorohydrin, polyvinylamine, polyvinylpyridine, polyvinylimidazole, condenced compounds of diallyldimethylammonium salts, and quaternary compounds of polyacrylic acid ester. Other preferred polymers are also described in Japanese Patent Publication Open to Public Inspection Nos. 10-193776, 10-21760, and 11-20300, and also in Japanese Patent Application No. 10-178126.

Cationic polymers of the present invention are not specifically limited, but the preferred weight-average molecular weight is 2000 to 100,000.

Employed as cationic mordants may be polymer mordants having a primary, secondary or tertiary amino group, and a quaternary ammonium salt group. Of these, polymer mordants having the quaternary ammonium salt group are preferred because discoloration due to aging and degradation of light fastness are minimal, and in addition mordant capability is sufficiently high.

Preferred polymer mordants are polymers having quaternary ammonium salt groups, and more preferred are homopolymers of monomers having the above cited quaternary ammonium salt group, copolymers, or condensation polymers with other monomers.

Examples of monomers having quaternary ammonium salt groups are as follows.

(1)

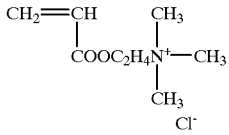

(2)

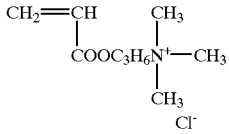

(3)

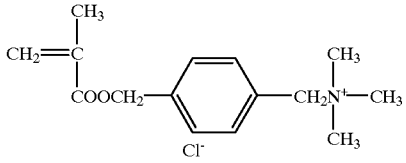

(4)

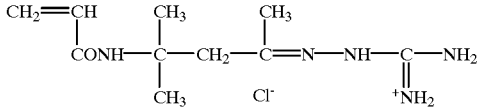

(5)

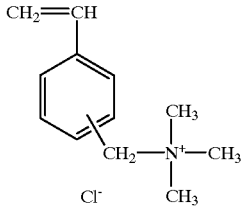

(6)

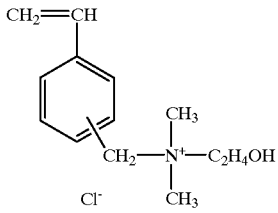

(7)

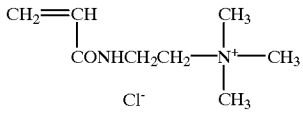

-continued (8)

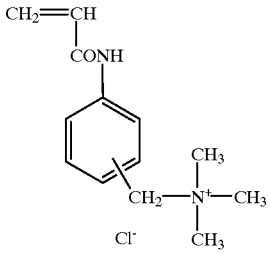

(9)

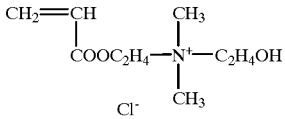

(10)

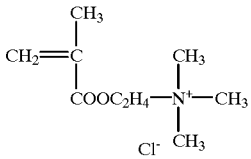

(11)

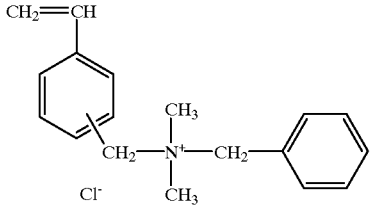

(12)

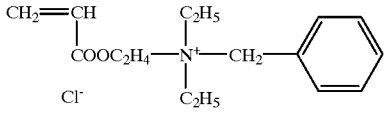

(13)

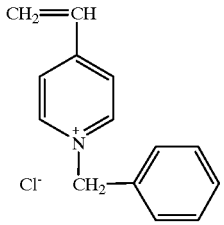

(14)

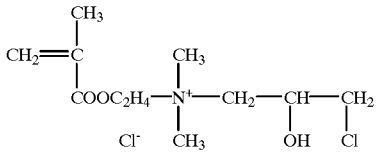

(15)

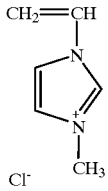

-continued
(16)
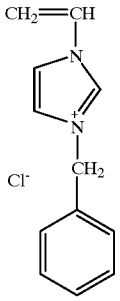
Monomers which can copolymerize with the above-mentioned monomers having quaternary ammonium salt groups are compounds having an ethylenic unsaturated group exemplified as follows.
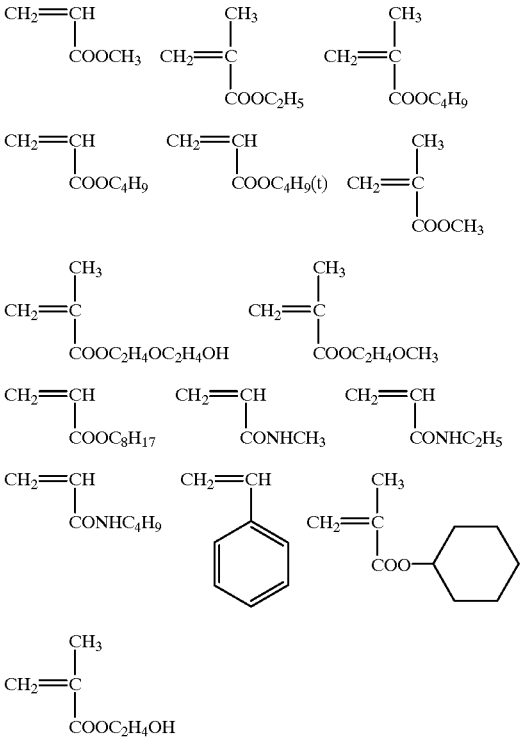
Examples of the cationic polymers of the present invention are shown, but the present invention is not limited to these.
P-1
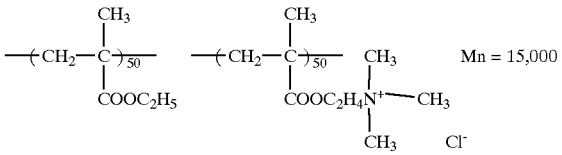
-continued
P-2
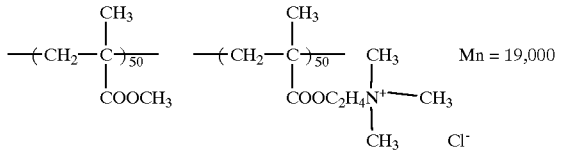
P-3
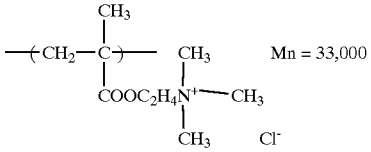
P-4
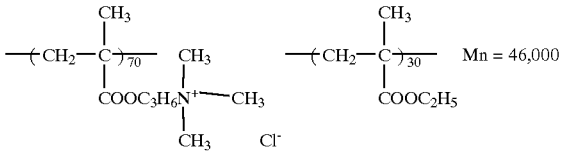
P-5
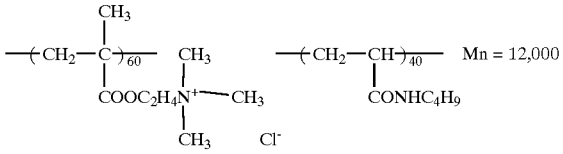
P-6
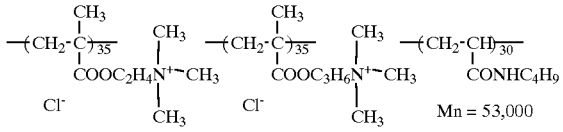
P-7
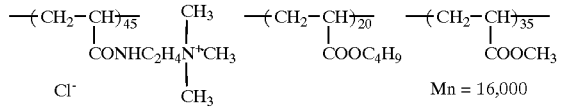
P-8
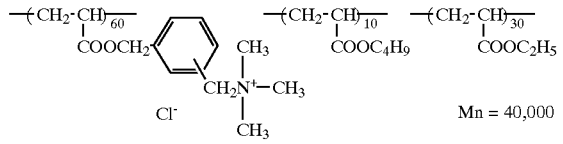
P-9
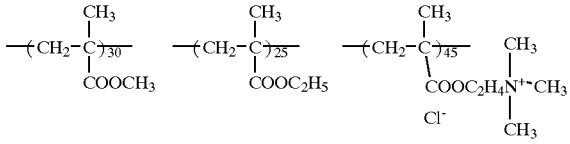
P-10
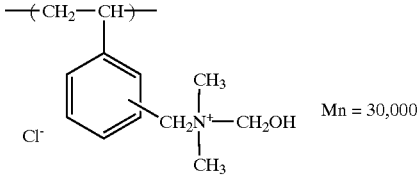

-continued

P-11

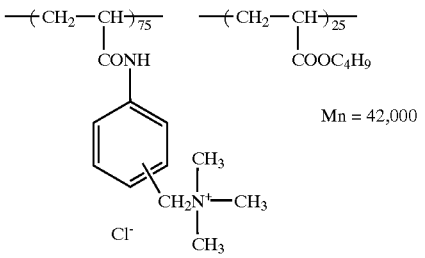

Mn = 42,000

P-12

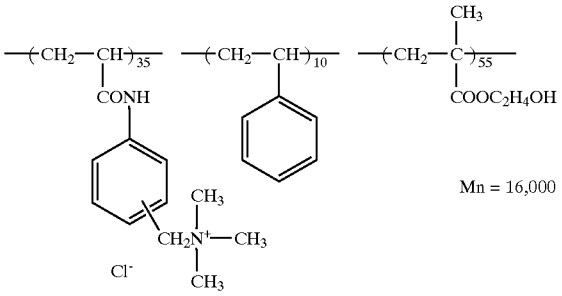

Mn = 16,000

P-13

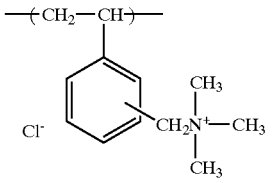

Mn = 24,000

P-14

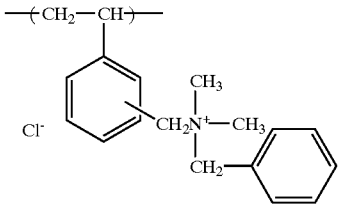

Mn = 9,000

P-15

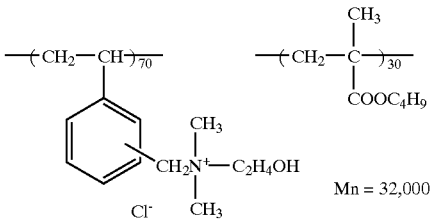

Mn = 32,000

P-16

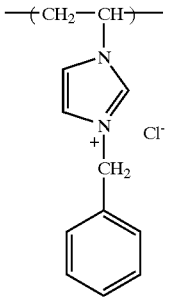

Mn = 50,000

-continued

P-17

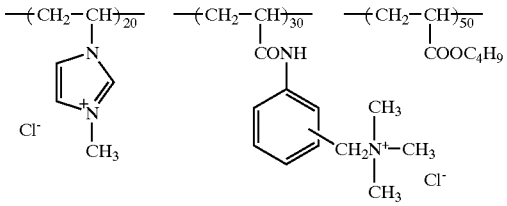

Mn = 24,000

When the cationic polymers having quaternary ammonium salt groups are copolymers, the ratio of the cationic monomer to the co-monomer is preferably more than 10 mol %, more preferably more than 20 mol %, and still more preferably more than 30 mol %.

The monomers having quaternary ammonium salt groups may be used singly or by mixing more than two kinds.

The cationic polymers featuring quaternary ammonium salt groups are generally more highly water-soluble due to the presence of the quaternary ammonium salt groups. But, they may not be sufficiently water-soluble depending on the ratio or the property of the co-monomer without quaternary ammonium salt group. Even then, these polymers can be used for the present invention if they are soluble in a mixture of a water miscible organic solvent and water.

Examples of the above-mentioned water miscible organic solvents are alcohols such as methanol, ethanol, isopropanol, and n-propanol; glycols such as ethylene glycol, diethylene glycol, and glycerin; esters such as ethyl acetate and propyl acetate; ketones such as acetone and methyl ethyl ketone; and amides such as N,N-dimethylformamide. Water miscible organic solvents are solvents which are soluble in water by more than 10 weight %. The weight ratio of water used is preferably less than that of the organic solvent.

Weight-average molecular weight is a converted value to the ethylene glycol value using gel permeation chromatography.

When a cationic polymer solution is added to a dispersion containing fine particles, the surface of which is anionic, unwanted aggregation may occur. This aggregation formation is less likely for cationic polymers having a weight-average molecular weight of less than 100,000, and a uniform dispersion without coarse particles is likely to occur. The ink-jet recording sheet using this kind of emulsion tends to yield high glossiness. For the same reason, the more preferable weight-average molecular weight is less than 50,000.

The lower limit of the weight-average molecular weight of the cationic polymer is usually 2000 in consideration of water resistance of the dye used in the ink.

The preferable weight ratio of the inorganic fine particles and the cationic polymer depends on the kind of fine particles, the average diameter, or the weight-average molecular weight of the cationic polymer. The preferable ratio is between 1:0.01 to 1:1 in order to cover the surface of the fine particles with a cationic polymer and stabilize the property of the particles.

Within the above-mentioned ratio, the anionic component of the fine particle surface will be fully covered with the cationic component. As a result, the formation of aggregated particles by ionic bonding, with the anionic component of the fine particle and the cationic component of the cationic polymer, can be avoided.

The amount of added cationic polymer is usually 0.01 to 0.3 part by weight and preferably 0.05 to 0.2 to 1 part of the inorganic fine particles.

In any layer of the ink-receiving layer side of the ink-jet recording sheet, various additives may be added as desired.

For example, it is possible to add various additives, known in the art, such as UV absorbers described in Japanese Patent Publication Open to Public Inspection Nos. 57-74193, 57-87988 and 2-261476; anti-fading agents described in Japanese Patent Publication Open to Public Inspection Nos. 57-74192, 57-87989, 60-72785, 61-146591, 1-95091, 3-13376; various anionic-, cationic- or nonionic-surface active agents; fluorescent whitening agents described in Japanese Patent Publication Open to Public Inspection Nos. 59-42993, 59-52689, 62-280069, 61-242871, 4-219266; pH-adjusting agents such as sulfuric acid, phosphoric acid, acetic acid, citric acid, sodium hydroxide, potassium hydroxide, potassium carbonate; anti-foaming agents; lubricants such as diethylene glycol; antiseptics; thickeners; antistatic agents; matting agents.

The ink-jet recording sheet may have two or more recording layers, each having a void-containing layer. In this case, the ratios of the fine inorganic particles in two or more of the void-containing layers to the hydrophilic binder may be different from each other. The under layer of the void-containing layers is also called as a porous interlayer.

Except for the void-containing layer, the ink-jet recording sheet may have a layer capable of being swelled by ink or a swelling layer without incorporating a void-containing layer.

Such a swelling layer may be provided under the void-containing layer (the side near support). Furthermore, when there are two or more of the void-containing layers, the swelling layer may also be provided between the void-containing layers. In such a swelling layer, a hydrophilic binder is generally employed. The binders employed in the layer include, for example, hydrophilic binders employed for the above-mentioned void-containing layer. The swelling layer which is provided under the void-containing layer is also called a non-porous interlayer.

Explained in detail below are the kinds of gelling agents and the methods of adding the gelling agents to the coating composition, which forms an ink absorptive layer on the surface of the water-absorptive support during the coating process of the ink absorptive layer.

The kinds of gelling agents and the methods of adding the gelling agents of the present invention enables to achieve the desired effects of the invention. The gelling agents form a gel on the surface of the ink absorptive layer during the coating of the ink absorptive layer on the surface of the support, of the non-porous interlayer, or of the porous interlayer. The formed gel prevents the penetration of the coating composition of the ink absorptive layer into the interior of the support.

Representative examples of the methods to gelatinize the coating composition for the ink absorptive layer on the surface of the support, of the non-porous interlayer, or of the porous interlayer are as follows:

(1) to adjust the surface pH of the support by addition of metal salts, to yield a surface pH≧8.0, or pH≦3.0;

(2) to employ ink absorptive coating compositions having the following the ratio of viscosity at 40° C. ($\eta 40$) and at 15° C. ($\eta 15$), $\eta 15/\eta 40 \geqq 100$, and $\eta 40 \geqq 100$ cp;

(3) to add gelling agents to a hydrophilic binder in the ink absorptive layer, to yield a gel state. For example, to pre-coat boric acid or borax to the surface of the support in an amount of more than 0.1 g/m$^2$.

(4) to coat an ink absorptive layer coating composition having a cationic component, after pre-coating an aqueous anionic polymer such as carboxymethylcellulose or acrylic acid grafted starch.

Addition of alkaline metal salts to the surface of the water absorptive support is one of the methods to adjust the surface pH to be more than 8.0. Examples of alkaline metal salts are hydroxides such as sodium hydroxide and potassium hydroxide; silicates such as sodium silicate; carbonate such as sodium carbonate; hydrogencarbonates such as sodium hydrogencarbonate; phosphates such as sodium phosphate and sodium dihydrogenphosphate; borates such as sodium borate and potassium borate; aluminates such as sodium aluminate and potassium aluminate; and zirconium carbonate ammonium. Addition of these alkaline metal salts to the water absorptive support can be made by coating their aqueous solution to the water absorptive support. Buffer solutions such as a mixture of glycine/sodium hydroxide and potassium chloride/sodium hydoxide are preferably used as aqueous solutions of the alkaline metal salts.

Addition of acidic metal salts to the surface of water absorptive support is one of the preferable methods to adjust the surface pH to be less than 3.0. Examples of acidic metal salts are zirconium oxychloride and zirconium sulfate. Addition of these acidic metal salts to the water absorptive support can be made by coating their aqueous solution to the water absorptive support, as is the case of alkaline metal salts.

When the metal salts are added to the water absorptive support, the amount is preferably 0.1 to 5 g/m$^2$.

When the gelling agents are added to gelatinize the hydrophilic binder of the ink absorptive layer, the amount of added metal salts is also preferably 0.1 to 5 g/m$^2$. In cases of using polyvinyl alcohol or various kinds of modified polyvinyl alcohols as a binder of the ink absorptive layer, it is preferably to add borate to the water absorptive support.

Non-porous Interlayer

Explained below is a non-porous interlayer having mainly a hydrophilic binder, which is provided between a water absorptive support and an ink absorptive layer.

A preferable non-porous interlayer used in the present invention is a layer which absorbs ink and subsequently swells. When the layer swells without limitation, the image portion is likely to be cockled or cracked during ink-jet recording. For this reason, the coating amount of the above-mentioned interlayer is preferably 0.01 to 5 g/m$^2$.

Examples of hydrophilic binders, which are employed in the ink absorptive layer of the present invention, are gelatin, polyvinylpyrrolidone (at a weight-average molecular weight being preferably more than 200,000), pullulan, polyvinyl alcohol and its derivatives (at a weight-average molecular weight being preferably more than 100,000), carboxymethyl cellulose, hydroxyethyl cellulose, dextran, dextrin, polyacrylic acid and its salt, agar, κ-carrageenan, λ-carrageenan, ι-carrageenan, xanthene gum, locust bean gum, alginic acid, Arabian gum, polyalkylene oxide copolymer described in Japanese Patent Publication Open to Public Inspection Nos. 7-15826, and 7-9757, water-soluble polyvinyl butyral, and homopolymer or copolymer composing vinyl monomer having a carboxyl group or a sulfo group described in Japanese Patent Publication Open to Public Inspection No. 62-245260. These hydrophilic binders may be used singly or in combination of two or more types.

Preferable hydrophilic binders are gelatin and its derivatives. Both an acid process gelatin and an alkali process gelatin may be used.

Gelatin derivatives whose amino groups are blocked with acid anhydride such as phthalic anhydride or isocyanate such as phenyl isocyanate are preferable.

The already mentioned cationic polymers may also be used, but in that case, it is preferable to use gelatin and gelatin derivatives, especially acid process gelatin, while especially preferred is an acid process gelatin whose isoelecrtic point is more than 6.

The preferable weight percentage of gelatin or gelatin derivatives to the total hydrophilic binder in the non-porous interlayer is 30 to 100%, and the more preferable weight is 50 to 100%.

In the non-porous interlayer, it is preferable to use a hydrophilic binder which can be cross-linked by the reaction of a hardener. The preferable amount of hydrophilic binder depends on the properties of the hardener. The amount of hydrophilic binder which can be cross-linked with the hardener is preferably more than 30 weight % based on the total hydrophilic binder in the non-porous interlayer.

Hardeners reacting with hydrophilic binders are compounds which react with a hydroxy group or an amino group in the hydrophilic binder. Examples of such hardeners are inorganic compounds such as chromium compounds, aluminum compounds, and boric acid; organic compounds having functional groups such as an epoxy group, an ethyleneimine group, an acryloyl group, and a formyl group.

When a cationic polymer mordant or a non-polymer mordant is incorporated in the interlayer, an inorganic hardener, a nonionic organic hardener, or a cationic organic hardener is preferably used in order to prevent aggregation of the mordant or a decrease of the mordant function.

The added amount of the hardener depends on the kinds of hydrophilic binder or hardener. Usually, the preferable range is from 1 to 200 mg, and more preferably from 5 to 100 mg, per gram of the above-mentioned hydrophilic binder which can be cross-linked.

The preferred amount of hardener is usually in the range of the above-mentioned values. However, when a hardening degree of the non-porous interlayer is measured according to following method, a value range of 0.5 to 5.0 is preferable to achieve the desired effects of the present invention.

The hardening degree can be measured using the following steps.

Step (I): Coating a layer forming material, containing a testing hardener, onto a non water absorptive support and drying it to produce a test sample.

Step (II): Immersing the test sample in 30° C. water for 1 minute to measure the absorbed amount of water.

Step (III): Dividing the absorbed amount of water by the amount of the hydrophilic binder in the layer. The value is defined as the hardening degree.

It is essential that the non-porous interlayer has basically no voids. "Has basically no voids" means that the ratio of the maximum absorbed water volume to the void volume in the hardened swelling-type interlayer is less than 20%.

In a swelled-type interlayer, voids may be formed by addition of inorganic fine particles such as secondary aggregated fine silica. When the void volume is small, the voids are blocked by the swelling effect of the hydrophilic binder. Consequently, an ink absorbing speed by an intrinsic voids in the ink absorptive layer is practically not affected.

When the void volume in the non-porous interlayer is increased, the thickness of the recording sheet also increases and the strength of the layer decreases.

Non-porous interlayer may be a multi-layered structure composed of different compositions of hydrophilic binders and additives. In such case, the hardening degree and the amount of the hydrophilic binder is defined to be the total of the hydrophilic binders.

Porous Interlayer

The porous interlayer provided between the water absorptive support and the ink absorptive layer will now be described.

The porous interlayer of the present invention comprises fine particles whose average diameter is 3 to 1000 nm. The porous interlayer is a layer whose void volume is more than 20% of the total volume of the porous interlayer. The preferred coating amount of the porous interlayer is 0.01 to 5 g/m$^2$.

More specifically, the following additives are preferably contained in the porous interlayer.

(1) inorganic fine particles and a hydrophilic binder
(2) organic fine particles and a hydrophilic binder
(3) organic fine particles and a hydrophobic binder
(4) self-cross linking resin and organic or inorganic fine particles
(5) self-cross linking resin, organic or inorganic fine particles, and colloidal silica composite
(6) organic or inorganic fine particles and colloidal silica composite
(7) colloidal silica composite Preferably used are compounds which are made to be water resistant by the reaction of cross linking agents.

At least one type of conventionally known fine particles may be used.

Examples of fine particles employed are white inorganic pigments such as precipitated calcium carbonate, heavy calcium carbonate, magnesium carbonate, kaolin, talc, calcium sulfate, barium sulfate, titanium dioxide, zinc oxide, zinc sulfide, zinc carbonate, zinc carbonate, satin white, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, magnesium hydroxide, and hydrolytic halloysite; organic pigments such as styrene-type plastic pigment, acryl-type plastic pigment, polyethylene, micro capsules, and melamine resin. Especially, porous fine resins are preferable in order to absorb much ink. More specifically, colloidal silica is preferable, and of colloidal silica, the following types are more preferred.

Examples of preferred colloidal silica are those which forms a long chain of spherical colloidal silica tied in a row, a branched type, and a bent type. Further, a wave undulation structure can be made on the surface. Colloidal silica is a material composed of interlinked primary particles of spherical silica with a metal ion of a balance of 2 or more. Preferably, it is composed of at least 3 silica particles, more preferably at least 5 particles, and still more preferably at least 7 particles. The maximum number of particles are preferable about 100 particles.

Usually the number of connected particles ranges from 3 to 100, more preferably 5 to 50, and still more preferably 7 to 30. When the number is less than 2, the degree of wave undulation is insufficient. When the number is more than 100, it is likely that the linearly connected silica particles or branched form increases the viscosity and lowers the degree of dispersion in water.

The colloidal silica may be a complex or a mixture of other inorganic particles such as alumina, ceria, and titania. These may be combined with metal ions, which preferably have a valence of 2 or more. Such metal ions are, for example, $Ca^{2+}$, $Zn^{2+}$, $Mg^{2+}$, $Ba^{2+}$, $Al^{3+}$, and $Ti^{4+}$. Especially, $Ca^{2+}$ is preferably used for making a colloidal silica tied in a row or in a branched form.

The primary particle diameter is usually 5 to 100 nm, and preferably 7 to 50 nm, and still more preferably 8 to 30 nm in order to absorb as much amount of ink as required.

The preferred content of linearly connected silica particles, or branched form, is 3 to 80 weight % of the interlayer weight, more preferably 10 to 70 weight %, and still more preferably 20 to 60 weight %. When the content is less than 3 weight %, the ink absorbance is likely to decrease due to lack of wave undulation on the surface of the recording sheet, however when the content is more than 80 weight %, the layer strength is likely to decrease.

The average particle diameter of the above-mentioned linearly connected silica particles is calculated from the particle diameter of 100 random particles. The minor axis of the composing particles is defined as the particle diameter and determined with electron microscopy.

Binders may be used in the porous interlayer of the present invention, within the limit which does not deteriorate the desired effects of the invention. Examples of the water-soluble binder used in the interlayer are preferably the same hydrophilic binders as described for the ink absorptive layer.

The self-cross linking resin preferably used in the porous interlayer is described below.

The self-cross linking resin is preferably a synthesized polymer latex. Examples of these are conjugate diene type copolymer latexes such as styrene-butadiene copolymer, methyl methacrylate-butadiene copolymer; acrylic polymer latex such as acrylic ester polymer and copolymer, methacrylic ester polymer and copolymer; vinyl polymer latex such as ethylene-vinyl acetate copolymer; and functional group modified polymer latexes such as latex comprised of a monomer containing carboxy groups. Another example is an emulsion which forms a water resistant layer after condensation of an epoxy group and an amino group, a resin having an amino group and an epoxy group, a resin having an alkoxysilyl group, a resin having an isocyanate group and an amino group, a resin having an isocyanate group and a hydroxy group, a resin having a urethan group and an amino group, a resin having a vinyl group and an amino group. Of these, a resin having an amino group and an epoxy group is preferably used.

Examples of self-cross linking synthetic polymer emulsions are acrylic copolymer emulsions such as Movinyl 747, Movinyl 760H, Movinyl 4700, Movinyl 761H, Movinyl 718, Movinyl 2000, and Movinyl 3410 made by Clariant Polymer Corporation; vinyl acetate copolymer emulsions such as Movinyl 771H and Movinyl 78H; and vinyl acetate-acrylic copolymer emulsions such as Appretan 2200. The present invention is however not limited to these cited materials.

The added amount of self-cross linking resin is typically 3 to 70 parts by weight based on 100 parts of the used pigment, but preferably it is 5 to 50 parts by weight. When it is less than 3 weight parts, the strength of the ink absorptive layer is insufficient, and when it is more than 70 weight parts, it tends to decrease the ink absorbance.

The colloidal silica emulsion preferably used in the porous interlayer is described below.

The colloidal silica composite preferably used in the present invention has in the center of the particles a polymer or a copolymer as a major component. The composite can be obtained by conventionally known emulsion polymerization of a monomer having an ethylenic unsaturated bond in the presence of colloidal silica, the method of which is described in Japanese Patent Publication Open to Public Inspection Nos. 59-71316 and 60-127371 in the emulsion form. The particle diameter of silica particles used for the colloidal silica composite is preferably less than 40 nm.

The preferred colloidal composites are those having the glass transition point ranging from −30 to 30° C.

When the glass transition point is less than 30° C., a glossy layer can be achieved, and in addition, the absorbance of a mixture solution of diethylene glycol/trietylene glycol monobutylether/water is enhanced, which are required for the present invention, while when the glass transition point is more than −30° C., blocking resistance becomes higher and is preferable.

As the colloidal silica used for the composite, primary particles whose diameter is 2 to 100 $\mu$m are usually cited. Examples of used ethylenic monomers are, for example, acrylic esters or methacrylic esters having an alkyl group of a carbon atom number being 1 to 18, an aryl group, or an ally group, styrene, $\alpha$-methylstyrene, vinyltoluene, acrylonitrile, vinyl chloride, vinylidene chloride, vinyl acetate, vinyl propionate, acrylamide, N-methylol acrylamide, ethylene, and butadiene, all of which are common knowledge in latex technology. Furthermore, if necessary, vinyl silanes such as vinyl trimethoxysilane, vinyl triethoxysilane, and $\gamma$-methacryloxipropyltrimethoxysilane may be added in order to increase the compatibility with the colloidal silica. In addition, also anionic monomers such as methacrylic acid, maleic acid, maleic anhydride, fumaric acid, and crotonic acid may be supplied to stabilize an emulsion. The ethylenic monomers can be used in combination with more than two kinds, as required.

The solid component weight ratio of the ethylenic monomer/the colloidal silica for emulsion polymerization is preferably between 100/1 to 100/200.

The preferable composites are ethylenic esters such as acrylic ester and methacrylic ester, more preferable complex emulsions are copolymers of acrylic ester or methacrylic ester with styrene, copolymers of acrylic alkylester or methacrylic alkylester with acrylic aralkylester or methacrylic aralkylester, and copolymers of acrylic alkylester or methacrylic alkylester with acrylic allylester or methacrylic allylester.

Examples of emulsifying agents used for emulsion polymerization are sodium alkylarylpolyethersulfonate, sodium lauryl sulfate, sodium alkylbenzenesulfonate, sodium polyoxyethylenenonylphenylethersitrate, sodium alkylarylsufosuccinate, and sodium sulfopropylmaleic acid monoalkylester.

Various kinds of back coating layers may be provided on the opposite face of the support having the ink absorptive layer of the recording sheet in order to minimize curling or adhesion immediately after ink-jet printing, or to enhance ink transferring property.

Recording sheets having the above-mentioned composition of the present invention can be obtained employing the following method.

An appropriate material for void-formation is dispersed in a solvent, such as water, alcohol, or various kinds of organic solvents, to prepare a coating dispersion. This coating dispersion is then coated on the water absorptive support and dried to form a void layer.

The ink absorptive layer or the interlayer is coated using conventionally known methods. Examples of preferable methods are a roll coating method, a rod bar coating method, an air-knife coating method, a blade coating method, a spray coating method, a curtain coating method or an extrusion coating method using a hopper described in U.S. Pat. No. 2,681,294.

Drying of the ink absorptive layer after coating is preferably done by increasing the viscosity of the coated solution by cooling or, after setting into a gel, by blowing high temperature air onto the surface of the coated layer.

The temperature of the coating composition of the ink absorptive layer is usually 25 to 60° C., and is preferably 30 to 50° C. The surface temperature after coating is preferably maintained at less than 20° C., and more preferably 5 to 15° C. The drying is preferably done with a stream of 20 to 60° C. air to obtain a uniform layer.

The wet thickness of the ink absorptive layer depends on the required dry thickness, and is usually 50 to 300 μm, and preferably 70 to 250 μm. The coating rate depends on the drying capacity, and is usually 20 to 200 m/min, while the drying duration is usually 2 to 10 minutes.

The total amount of the solid coating materials in the ink absorptive layer and in the interlayer of the ink-jet recording sheet of the present invention is usually 5 to 40 g/m$^2$, and preferably 10 to 30 g/m$^2$.

The aqueous ink employed for the ink-jet recording sheet is explained below.

The aqueous ink is an ink-jet recording liquid composed generally of a water-soluble dye, a liquid medium and other additives. As water-soluble dyes, employed may be water-soluble dyes such as direct dyes, acid dyes, basic dyes, reactive dyes for ink-jet or food dyes. Of these, the direct or acid dyes are preferred.

The solvent of the aqueous ink consists mainly of water. However, in order to prevent clogging at the outlet of a nozzle or in an ink-supplying path due to dye deposits caused by drying, usually employed is a high boiling point organic solvent, having a boiling point of at least 120° C. and which remains in a liquid state at room temperature. A high boiling point organic solvent is required to have a much lower vapor pressure than that of water in order to exhibit the function of preventing the formation of coarse deposits of solid components, such as dye, when water is vaporized. On the other hand, the solvent is required to exhibit high compatibility with water.

Organic solvents having a high boiling point are generally employed in most cases to achieve the above-mentioned object. Specific examples include a series of alcohols such as ethylene glycol, propylene glycol, diethylene glycol, triethylene glycol, glycerin, diethylene glycol monomethyl ether, diethylene glycol monobutylether, triethylene glycol monobutylether, glycerin monomethyl ether, aqua 1,2,3-butanetriol, 1,2,4-butanetriol, 1,2,4-pentanetriol, 1,2,6-hexanetriol, thiodiglycol, triethanolamine, and polyethylene glycol (at featuring an average molecular weight of 300 or less). Besides these, dimethylformamide, N-methylpyrrolidone, etc. may also be employed.

Of these high boiling point organic solvents, those preferred include polyhydric alcohols such as diethylene glycol, triethanolamine, glycerin, etc., and lower alkyl ethers of polyhydric alcohol such as triethylene glycol monobutylether.

Other additives incorporated in the aqueous ink include, for example, pH-adjusting agents, metal-blocking agents, fungicides, viscosity-adjusting agents, surface tension-adjusting agents, wetting agents, surface active agents, anti-rusting agents, etc.

With the object for improving the wettability of the aqueous ink on the ink-jet recording sheet and stabilizing the discharge from ink-jet nozzles, an aqueous ink should be provided with a surface tension at 25° C., in the range of 25 to 50 dyne/cm and preferably in the range of 28 to 40 dyne/cm.

The viscosity of the aqueous ink should range, at 25° C., generally from 2 to 8 cp and preferably from 2.5 to 5 cp. The pH of the aqueous ink ranges generally from 4 to 10.

Desired minimum ink droplets discharged from the ink nozzle have a volume between $1\times10^{-3}$ and $30\times10^{-3}$ nl. By using these droplets, printed minimum dot diameters of about 20 to about 60 μm can be obtained on the ink-jet recording sheet. A color print printed with such dot diameters results in a high quality image. More preferred minimum droplet is a droplet having a volume between $2\times10^{-3}$ and $20\times10^{-3}$ nl.

When the above-mentioned aqueous ink, at least for magenta and cyan color, is employed in a method in which recording is performed with two kinds of inks whose ink concentration is 2 times or more different from each other, identification of individual dots at highlight area becomes difficult because a low concentration ink is employed at highlight area. The present invention can be applied to the case in which the method mentioned above is employed.

In an ink-jet recording system, as a recording method, various methods conventionally known in the art may be employed. The details are described in "Ink-jet Kiroku Gijutsu Doko (Trends of Ink-jet Recording Technology), Edited by Koichi Nakamura, Mar. 31, 1995, Published by Nihon Kagaku Joho Co.".

EXAMPLES

The present invention is explained below with reference to Examples.

If there is no specific note, the "%" value in Examples means percentage by absolute dry weight.

Example-1

Preparation of Silica Dispersion-1

Using Jet-stream Inductor Mixer TDS (available from MITAMURA RIKEN KOGYO Co., Ltd.), 125 kg of silica prepared by a gas phase process, having an average primary particle size of 0.007 μm (Aerosil 300, available from Aerosil Kogy Co., Ltd.) was dispersed by aspiration dispersion in 620 l of water adjusted with nitric acid to a pH of 3.0 at room temperature. Then 1.5 l of Uvitex NFW liq (Ciba Speciality Chemicals Co,. Ltd.) was added, and then, the total volume was made to be 694 l with adding water.

Preparation of Silica Dispersion-2

To 18 liters of an aqueous solution (pH=3.0) containing 1.63 g of cationic polymer (P-9), 2.2 l of ethanol and 1.5 l of n-propanol, was added 69.4 l of Silica Dispersion-1 while stirring, then further was added 1 l g of anti-forming agent (SN381, SAN NOPCO Ltd).

The mixture was dispersed using a high-speed homomixer (made by Sanwa Kogyo Corporation) and water was added to make a total volume of 97 l to obtain Silica Dispersion-2.

The obtained Silica Dispersion-2 was diluted and coated on a transparent support, and then, was measured with electron microscopy. The measured average particle diameter was 50 nm.

Preparation of Coating Composition-1

Using the above-mentioned Silica Dispersion-2, the following coating composition was prepared.

To 650 ml of the Silica Dispersion-2 were successively added the following additives with stirring at 40° C.

| | | |
|---|---|---|
| (1) | 10% Polyvinyl alcohol aq. solution (PVA203, available from KURARAY Co., Ltd.) | 6 ml |
| (2) | 5% Polyvinyl alcohol aq. solution (PVA235, available from KURARAY Co., Ltd.) | 190 ml |
| (3) | 5% Polyvinyl alcohol aq. solution (PVA245, available from KURARAY Co., Ltd.) | 70 ml |
| (4) | 30% solution of surfactant S-1 | 4 ml |
| (5) | Anionic fluorescent brightening agent 10% aq. Solution (UVIT EX NFW LIQUID 9; Ciba Specialty Chemicals Co., Ltd.) | 40 ml |
| (6) | Pure water to make | 1000 ml |

The pH of the obtained solution was 4.5.

S-1

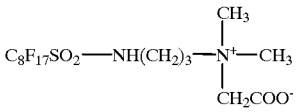

Preparation of a Base Paper

The following three kinds of pulp having the weight parts were used.

(1) Hardwood kraft pulp having a Canadian standard filtration degree of 300 ml (LBKP); 70 weight parts (2) Bleach sulfite hardwood pulp having a Canadian standard filtration degree of 280 ml (LBSP); 25 weight parts (3) Softwood kraft pulp having a Canadian standard filtration degree of 280 ml (NBKP); 5 weight parts (1), (2), and (3) were mixed, and a pulp having an weight-average fiber length of 0.65 mm was obtained using a double-disc refiner. To 100 weight parts of the obtained beaten pulp were added 2.0 weight parts of cationic starch, 0.4 weight part of an alkyl ketene dimer sizing agent, 0.1 weight of anionic polyamide, and 0.7 weight of polyamido polyamino epichlorohydrine resin, which was then adjusted to pH 7.5. A Base Paper of 212 g weight and thickness of 200 $\mu$m was made using a Fourdrinier machine.

Preparation of a Recording Sheet

The above-mentioned Coating composition-1 was applied onto the above-mentioned Base Paper at a wet thickness of 175 $\mu$m. After cooling to about 7° C., the resultant coating was dried with air flow at 20 to 65° C. to result in Recording Sheet 101. The dried thickness of the void-forming layer of Recording Sheet 101 was found to be 40 $\mu$m, and the amount of solid coating was 24 g/m$^2$.

The amount of ink transfer of Recording Sheet 101, measured with the Bristow Test, was 25 ml/m$^2$, and the Cobb value was 42 g/m$^2$.

Preparation of Recording Sheets 102 to 110

Recording Sheets 102 through 110 were obtained in the same way as Recording Sheets 101 by changing the thickness of Base Paper 1, or varying the mixing ratio of cationic starch, alkyl ketene dimer resin, anionic polyacrylic amide resin, or polyamido polyamino epichlorohydrine resin. The measured ink transfer value $Q_1$ (Bristow Test), and Cobb Value $Q_2$ are listed in Table 1.

Preparation of Recording Sheets 111

The Coating composition-1 was applied onto a polyethylene coated paper prepared by laminating a 170 g/m$^2$ Base Paper with polyethylene on both sides (in which the polyethylene on the ink receiving layer side comprised anatase type titanium dioxide in an amount of 8 percent by weight; a 0.05 g/m$^2$ gelatin sublayer was applied to the surface of the ink receiving layer side, while on the opposite side, a backing layer was applied, which was comprised of 0.2 g/m$^2$ of a latex polymer having a Tg of about 80° C.; (this was called an RC base) to obtain a wet layer thickness of 175 $\mu$m, and temporarily cooled at about 7° C. Thereafter, the resultant coating was dried under an air flow at 20 to 65° C. Thus Recording Sheet 111 was prepared. The dried thickness of the void-forming layer of Recording Sheet 111 was found to be 40 $\mu$m.

The obtained Recording Sheets were subjected to the following tests and evaluated.

(1) The Amount of Liquid Transfer with Bristow Test

The amount of liquid transfer was measured with a method described in J. TAPPI Paper-Pulp Test Method No. 51-87, which indicates liquid absorptiveness of paper and paper board. The relating reference is found in a literature, Tappi J, 65 (12) 98 (1982). A Bristow Test Machine Type II (compression type) manufactured by Kumagai Riki Kogyo Co., Ltd. was employed, by which a transfer amount (ml/m$^2$) during a contact duration of 1.0 second was obtained as a void volume ($Q_1$). The liquid used for testing was a mixture of diethylene glycol/trietylene glycol monobutylether/water, at a weight ratio of 15:15:70. J. TAPPI indicates using a pressure of 0.1 MPa as a standard, however, the Recording Sheets tested have a good absorbance and would is likely be torn during measurement under this pressure condition. The pressure value was adjusted to 0.05 MPa, however other conditions were in accordance with the J. TAPPI method. To the liquid, used for testing, was added a water soluble dye, Acid Red 52, 2% (Daiwa Kasei Co., Ltd).

(2) Cobb Water Absorptiveness Value

Water absorptiveness was measured using the method described in JIS P8140, in which the contact time is fixed as 60 seconds, and a mixture of diethylene glycol/trietylene glycol monobutylether/water, at a weight ratio of 15:15:70 was used, and the Cobb value, $Q_1$, (g/m$^2$) was obtained.

(3) Glossiness

The specular gloss at 60° was measured employing a Variable Angle Photometer (VGS-101DP) manufactured by Nihon Denshoku Kogyo Co., Ltd.

(4) Cockling

The degree of cockling on the printed recording sheet was visually evaluated according to the following criteria. The Ranks A or B are acceptable for practical use.

A: No detectable cockling, acceptable for practical use

B: Minor cockling, acceptable for practical use

C: Major cockling, unacceptable for practical use (5) Bleeding Resistance

Each of the ink-jet recording sheets was subjected to printing by an Ink-jet Printer PM770C, manufactured by Seiko Epson Co., Ltd., to obtain black lines (about 200 $\mu$m width). Then the printed samples were stored at 40° C., 80% RH, for 5 days. Evaluation was done by observing the degree of bleeding after storing according to the following criteria.

A: No bleeding, acceptable for practical use

B: Minor amount of bleeding, but still acceptable for practical use

C: Major amount of bleeding, unacceptable for practical use (6) Maximum Density

Each of the ink-jet recording sheets was subjected to printing by an Ink-jet Printer PM770C, manufactured by Seiko Epson Co. Ltd., to obtain yellow, magenta, and cyan colored prints. The reflectance was measured by using single light beams of blue, green, or red.

(7) Image Quality

The image quality after ink-jet printing was visually evaluated using to the following criteria.

A: Even color

B: Slightly uneven color

C: Distinctly uneven color, unacceptable for practical use

Evaluation results are listed in Table 1.

TABLE 1

| Recording sheet | Support (thickness) | Transferred amount by Bristow Test $Q_1$ (ml/m$^2$) | Cobb absorptiveness value $Q_2$ (g/m$^2$) | $Q_1/Q_2$ | Glossiness | Cockling | Bleeding resistance | Maximum density Y | M | C | Image quality |
|---|---|---|---|---|---|---|---|---|---|---|---|
| 101 (Inv.) | Base paper 1 (200 μm) | 25 | 42 | 0.60 | 22 | B | A | 1.72 | 1.92 | 2.05 | B |
| 102 (Inv.) | Base paper 2 (250 μm) | 34 | 51 | 0.67 | 23 | A | A | 1.72 | 1.92 | 2.05 | B |
| 103 (Inv.) | Base paper 3 (175 μm) | 18 | 27 | 0.67 | 25 | B | B | 1.74 | 1.96 | 2.06 | B |
| 104 (Inv.) | Base paper 4 (200 μm) | 28 | 80 | 0.35 | 21 | B | A | 1.70 | 1.90 | 2.02 | B |
| 105 (Inv.) | Base paper 5 (200 μm) | 21 | 53 | 0.40 | 19 | B | A | 1.74 | 1.96 | 2.06 | B |
| 106 (Comp.) | Base paper 6 (200 μm) | 37 | 49 | 0.76 | 18 | C | A | 1.70 | 1.90 | 2.02 | C |
| 107 (Comp.) | Base paper 7 (200 μm) | 36 | 60 | 0.60 | 20 | C | A | 1.74 | 1.96 | 2.06 | C |
| 108 (Comp.) | Base paper 8 (200 μm) | 19 | 24 | 0.79 | 21 | B | C | 1.65 | 1.85 | 1.94 | C |
| 109 (Comp.) | Base paper 9 (200 μm) | 14 | 28 | 0.50 | 22 | B | C | 1.62 | 1.83 | 1.93 | C |
| 110 (Comp.) | Base paper 10 (200 μm) | 18 | 67 | 0.27 | 23 | C | B | 1.72 | 1.92 | 2.05 | C |
| 111 (Comp.) | RC (220 μm) | 20 | 21 | 0.95 | 35 | A | C | 1.64 | 1.87 | 1.92 | C |

Inv.: Invention, Comp.: Comparison

As is demonstrated by Table 1, Recording sheet 111, using RC Base Paper, showed good glossiness and good cockling property, but the ink absorbance of the ink absorptive layer was insufficient. As a result, it exhibited not only unevenness of printing, but the bleeding resistance was also low.

The ratio of $Q_1/Q_2$ for Recording Sheets 106 through 110 was outside the range of the present invention. They satisfied neither the cockling property nor the bleeding resistance. Furthermore, they exhibited undesirable image quality. The liquid transfer amount $Q_1$ was measured with the Bristow Test and $Q_2$ was a Cobb value.

Recording Sheets 101 through 105, having $Q_1/Q_2$ within the range of the invention, showed good cockling property and improved bleeding resistance. Photo-grade printing requires having a glossiness value of more than 20%. Recording Sheets 101 through 105 were found to have good glossiness, and enhanced maximum density and image quality. In particular, Recording Sheets 101 through 105 have better image density than Recording Sheet 111, and yielded images with higher definition, which is a preferable property.

Example-2

Preparation of Recording Sheets 201 to 204

Recording Sheets 201 through 204 were prepared in a similar way as preparing Recording Sheet 101 by changing the coating amount of the solid part of Silica Dispersion-1 in Coating composition-1 of Example-1. The changed coating amount are listed in Table-2.

Preparation of Recording Sheets 205

Recording Sheets 205 was prepared in a way similar to preparing Recording Sheet 101 by using Coating Composition-2, which was made by substituting Silica Dispersion-1 in the coating composition-1 of Example-1 with Silica Dispersion-2. The composition of Silica Dispersion-2 is described below.

Preparation of Recording Sheets 206

Recording Sheets 206 was prepared in a way similar to preparing Recording Sheet 201 by using Coating composition-2, which was made by substituting Silica Dispersion-1 in Coating composition-1 of Example-1 with Silica Dispersion-2. The composition of Silica Dispersion-2 is described below.

The evaluation was done in a similar way as in Example-1. The average particle diameter of the secondary aggregation particles of the void-forming layer in Recording Sheets 205 and 206 was found to be 207 nm by observing the cross section using electron microscopy.

Silica Dispersion-2

125 g of TT600 (silica having an average primary particle diameter 40 nm made with a dry method, available from Aerosil Kogyo Co., Ltd.) was dispersed in 620 ml of water by a dispersion mill, and then was adjusted to 694 ml with adding water. The evaluation was done in a similar way as for Example-1 and the results are shown in Table-2.

TABLE 2

| Recording sheet | Ink absorptive layer (coating amount) | Transferred amount by Bristow Test $Q_1$ (ml/m$^2$) | Cobb absorptiveness value $Q_2$ (g/m$^2$) | $Q_1/Q_2$ | Glossiness | Cockling | Bleeding resistance | Maximum density Y | Maximum density M | Maximum density C | Image quality |
|---|---|---|---|---|---|---|---|---|---|---|---|
| 101 (Inv.) | Coating solution-1 (24 g/m$^2$) | 25 | 42 | 0.60 | 22 | B | A | 1.72 | 1.92 | 2.05 | B |
| 201 (Inv.) | Coating solution-1 (30 g/m$^2$) | 31 | 48 | 0.65 | 24 | B | A | 1.72 | 1.92 | 2.05 | B |
| 202 (Inv.) | Coating solution-1 (7.5 g/m$^2$) | 18 | 27 | 0.67 | 21 | B | B | 1.74 | 1.96 | 2.03 | B |
| 203 (Inv.) | Coating solution-1 (40 g/m$^2$) | 33 | 50 | 0.65 | 24 | B | A | 1.72 | 1.92 | 2.05 | B |
| 204 (Inv.) | Coating solution-1 (3.5 g/m$^2$) | 15 | 25 | 0.60 | 21 | B | B | 1.67 | 1.87 | 1.99 | B |
| 205 (Comp.) | Coating solution-2 (24 g/m$^2$) | 28 | 49 | 0.57 | 11 | B | B | 1.53 | 1.73 | 1.82 | C |
| 206 (Comp.) | Coating solution-2 (30 g/m$^2$) | 35 | 49 | 0.71 | 12 | B | B | 1.52 | 1.74 | 1.83 | C |

Inv.: Invention, Comp.: Comparison

As is demonstrated by Table 2, Recording Sheet 205, which has an ink absorptive layer containing particles of more than 200 nm, showed extremely low glossiness and low maximum density, and the overall image quality was unacceptable.

All of Recording Sheets 101, 201 through 204 showed the desired effects of the present invention. Recording Sheets 203 and 204, which have a coating amount of outside of 7 to 30 g/m$^2$, showed the desirable effects of the invention, but coating imperfection was appeared.

Example-3

Preparation of Recording Sheets 301 to 303

Recording Sheets 301 through 303 ware prepared in a way similar to preparing Recording Sheet 101 except for using the support shown in Table 3. The evaluation was done in the same way as for Example-1, and the results are shown in Table 3.

Preparation of Coated Paper A

Base Paper 31 was prepared in a way similar to preparing Base Paper 1 except for using the support of 110 $\mu$m. To Base Paper 31 was added a coating mixture composed of kaolin, calcium carbonate, titanium oxide, modified starch, and methyl methacrylate latex to yield Coated Paper A.

Preparation of Coated Papers B and C

Coated Papers B and C were prepared in a way similar to Coated Paper A except for changing the thickness of the Base Paper, the degree of sizing, and the ratio of the ingredient composing the above-mentioned coating mixture.

TABLE 3

| Recording sheet | Support (thickness) | Transferred amount by Bristow Test $Q_1$ (ml/m$^2$) | Cobb absorptiveness value $Q_2$ (g/m$^2$) | $Q_1/Q_2$ | Glossiness | Cockling | Bleeding resistance | Maximum density Y | Maximum density M | Maximum density C | Image quality |
|---|---|---|---|---|---|---|---|---|---|---|---|
| 101 (Inv.) | Base paper 1 (200 $\mu$m) | 25 | 42 | 0.60 | 22 | B | A | 1.72 | 1.92 | 2.05 | B |
| 108 (Comp.) | Base paper 8 (200 $\mu$m) | 19 | 24 | 0.79 | 21 | B | C | 1.65 | 1.85 | 1.94 | C |
| 301 (Inv.) | Coated paper A (130 $\mu$m) | 22 | 33 | 0.67 | 25 | B | B | 1.75 | 2.01 | 2.07 | A |
| 302 (Inv.) | Coated paper B (150 $\mu$m) | 20 | 29 | 0.69 | 27 | B | B | 1.76 | 2.03 | 2.08 | A |
| 303 (Comp.) | Coated paper C (185 $\mu$m) | 27 | 96 | 0.28 | 18 | C | B | 1.64 | 1.83 | 1.92 | C |

Inv.: Invention, Comp.: Comparison

As is demonstrated by Table 3, Recording Sheets 301 through 303, which have a $Q_1/Q_2$ ratio ($Q_1$: Amount of transfer by Bristow Test, $Q_2$: Cobb value) within the range of the invention, showed the desired effects of the present invention even by using the coated paper.

Example-4

1 ml of 0.1 mol/l aqueous solution of sodium aluminate and other gelling agents shown in Table 4 were added to 10 ml of Coating composition-1 in Example-1. It was found that the coating compositions were gelatinized by this procedure.

Preparation of Recording Sheet 401

Onto the Base Paper made for preparing Recording Sheet 101 in Example-1 was coated an aqueous sodium aluminate to yield a coating amount of 1.0 g/m$^2$. After being dried, Coating composition-1 was applied and dried in a way similar to preparing Recording Sheet 101 to obtain Recording Sheet 401.

Preparation of Recording Sheet 402

An aqueous gelling agent (zirconium carbonate ammonium) was coated and dried to yield a coating amount of 1.0 g/m$^2$. Then Coating composition-1 was coated in a way similar to preparing Recording Sheet 103 and dried to obtain Recording Sheet 402.

Preparation of Recording Sheet 403

An aqueous gelling agent (borax) was coated and dried to yield the coating amount of 1.0 g/m$^2$. Then coating composition-1 was coated in a similar way as for preparing Recording Sheet 101 and dried to obtain Recording Sheet 403.

Preparation of Recording Sheet 404

An aqueous gelling agent (borax) was coated and dried to yield a coating amount of 1.0 g/m$^2$. Then Coating composition-1 was applied in a way similar to preparing Recording Sheet 108 and dried to obtain Recording Sheet 404.

During the preparation of Recording Sheets 401 and 402, the surface pH of the water absorptive support, after addition of a gelling agent onto Base Papers 1 and 3, was more than 8. The evaluation was done in a similar way as in Example-1. The result were shown in Table 4.

TABLE 4

| Recording sheet | Paper support | Gelling agent | Transferred amount by Bristow Test $Q_1$ (ml/m$^2$) | Cobb absorptiveness value $Q_2$ (g/m$^2$) | $Q_1/Q_2$ | Glossiness | Cockling | Bleeding resistance | Maximum density Y | Maximum density M | Maximum density C | Image quality |
|---|---|---|---|---|---|---|---|---|---|---|---|---|
| 101 (Inv.) | Base paper 1 | None | 25 | 42 | 0.60 | 22 | B | A | 1.72 | 1.92 | 2.05 | B |
| 108 (Comp.) | Base paper 8 | None | 19 | 24 | 0.79 | 21 | B | C | 1.65 | 1.85 | 1.94 | C |
| 401 (Inv.) | Base paper 1 | Sodium aluminate | 34 | 51 | 0.67 | 31 | A | A | 1.77 | 1.95 | 2.08 | A |
| 402 (Inv.) | Base paper 3 | Zirconium carbonate ammonium | 18 | 27 | 0.67 | 30 | A | A | 1.75 | 1.98 | 2.07 | A |
| 403 (Inv.) | Base paper 1 | Borax | 29 | 42 | 0.69 | 32 | B | A | 1.76 | 1.94 | 2.03 | A |
| 404 (Comp.) | Base paper 8 | Borax | 17 | 23 | 0.74 | 24 | B | C | 1.65 | 1.85 | 1.94 | C |

Inv.: Invention, Comp.: Comparison

As is demonstrated by Table 4, Recording Sheet 404 having a $Q_1/Q_2$ ratio outside the range of the invention, did not show the desired effects of the present invention even by adding the gelling agent to the water absorptive support. The gelling agents are capable of gelling the coating composition which forms the ink absorptive layer.

Recording Sheets 401 to 403 having a $Q_1/Q_2$ ratio within the range of the invention showed the desired effects of the present invention by adding the gelling agent to the water absorptive support. In addition, Recording Sheets 401 through 403 showed improved glossiness and higher maximum density, and in addition the image quality was excellent.

Example-5

The following coating composition was prepared.

Coating Composition-3

| | | |
|---|---|---|
| (1) | Acid process gelatin (isoelecrtic point; 7.8) | 42 g |
| (2) | Saponin | 25 ml |
| (3) | DIDP dispersion (*) | 40 ml |

-continued

| | | |
|---|---|---|
| (4) | Titanium oxide dispersion (**) | 40 ml |
| (5) | Pure water to make | 1000 ml |

(*): 3 g of diisodecyl phthalate and 0.15 g of fluorescent brightening agent-1 (UVITEX-OB, made by Ciba Speciality Chemicals Co,. Ltd.) were dissolved in 8 ml of ethyl acetate while heating. The obtained solution was added to 20 ml of an aqueous solution containing 8% of acid process gelatin and 2% of saponin, and was then dispersed by emulsification. Finally, water was added to the dispersion to adjust the total volume to 40 ml.

(**): 12 g of titanium oxide (KR310, made by Titan Kogyo Kabushiki Kaisha) was mixed with 30 ml of water using high speed homogenizer at 10,000 rpm for 5 minutes. And finally water was added to adjust the total volume to 40 ml.

Preparation of Recording Sheet 501

Coating Composition-3 was coated on Base Paper 1 at 40° C. to yield a solid coating amount of 3 g/m$^2$ and dried. Then, Coating composition-1 was further coated thereon to yield a wet layer thickness of 175 $\mu$m. After cooling to about 7° C., the resultant coating was dried under an air flow of 20 to 65° C. to yield Recording Sheet 501. The dried thickness of the void-forming layer of Recording Sheet 501 was noted to be 40 $\mu$m.

Preparation of Recording Sheet 502

Coating Composition-3 was coated on Base Paper 1 at 40° C. to yield a solid coating amount of 7 g/m$^2$, and dried. Then, Coating composition-1 was further coated thereon to yield a wet layer thickness of 175 $\mu$m. After cooling to about 7° C., the resultant coating was dried under an air flow of 20 to 65° C. to yield Recording Sheet 502.

Preparation of Recording Sheet 503

Coating Composition-3 was coated onto Base Paper 1 at 40° C. to yield a solid coating amount of 3 g/m$^2$, and dried. Then, an aqueous solution of sodium aluminate, which is a gelling agent incorporated in Coating composition-1, was further coated thereon in an mount of 1 g/m$^2$ and dried. Further, coating composition-1 was coated to yield a wet layer thickness of 175 $\mu$m. After cooling to about 7° C., the resultant coating was dried under an air flow of 20 to 65° C. to yield Recording Sheet 503. The evaluation was done in a way similar to the evaluation in Example 1 and the results were shown in Table 5.

As is demonstrated by Table 5, Recording Sheets 501 through 503 showed the desired effects of the present invention. In particular, Recording Sheets 501 and 503 showed exemplary effects, specifically, their compatible properties of both cockling and bleeding resistance being superior to that of Recording Sheet 502.

Example-6

Preparation of Recording Sheet 601

The following coating composition was prepared.

| | | |
|---|---|---|
| (1) | Colloidal silica complex particle acrylic emulsion (Movinyl 8020, made by Clariant Polymer Corporation) | 100 weight parts |
| (2) | Beaded colloidal silica (SNOWTEX PS-1, made by Nissan Chemical Industry, Ltd.) | 25 weight parts. |

Onto Base Paper 1 was coated the above-cited coating composition as a porous interlayer in a dried coating amount of 30 g/m$^2$. After being dried, Coating composition-1 was coated as an ink absorptive layer in a way similar to preparing Recording Sheet 101, resulting in Recording Sheet 601.

Preparation of Recording Sheet 602

The following coating composition was prepared.

| | | |
|---|---|---|
| (1) | Self-cross linking acrylic emulsion (Movinyl 747, made by Clariant Polymer Corporation). | 50 weight parts |
| (2) | Beaded colloidal silica (SNOWTEX PS-1, made by Nissan Chemical Industry, Ltd.) | 25 weight parts. |
| (3) | Beaded colloidal silica (SNOWTEX XL, made by Nissan Chemical Industry, Ltd) | 25 weight parts. |

On Base Paper 1 was coated the above-mentioned coating composition as a porous interlayer in a dried coating amount of 20 g/m$^2$ in a way similar to preparing Sheet 101 and then was dried to result in Recording Sheet 602.

TABLE 5

| Recording sheet | Non-porous interlayer (coating amount) | Transferred amount by Bristow Test $Q_1$ (ml/m$^2$) | Cobb absorptiveness value $Q_2$ (g/m$^2$) | $Q_1/Q_2$ | Glossiness | Cockling | Bleeding resistance | Maximum density Y | Maximum density M | Maximum density C | Image quality |
|---|---|---|---|---|---|---|---|---|---|---|---|
| 101 (Inv.) | None | 25 | 42 | 0.60 | 22 | B | A | 1.72 | 1.92 | 2.05 | B |
| 108 (Comp.) | None | 19 | 24 | 0.79 | 21 | B | C | 1.65 | 1.85 | 1.94 | C |
| 501 (Inv.) | 3 g/m$^2$ | 24 | 35 | 0.69 | 31 | A | A | 1.72 | 1.92 | 2.05 | A |
| 502 (Inv.) | 7 g/m$^2$ | 19 | 28 | 0.68 | 30 | B | B | 1.74 | 1.96 | 2.06 | A |
| 503 (Inv.) | 3 g/m$^2$ | 22 | 32 | 0.69 | 34 | A | A | 1.73 | 1.93 | 2.05 | A |

Inv.: Invention, Comp.: Comparison

Preparation of Recording Sheet 603

The following coating composition was prepared.

| | |
|---|---|
| (1) Colloidal silica complex particle acrylic emulsion (Movinyl 8020, made by Clariant Polymer Corporation). | 100 weight parts |
| (2) Beaded colloidal silica (SNOWTEX PS-1, made by Nissan Chemical Industry, Ltd.) | 25 weight parts |
| (3) Silil modified PVA (R-1130, made by KURARAY Co., Ltd.) | 25 weight parts |

On Base Paper 1 was coated the above-mentioned coating composition as a porous interlayer in a dried coating amount of 5 g/m$^2$ in a similar way as for Recording Sheet 101 and then dried to result in Recording Sheet 603. The evaluation was done in a way similar to the evaluation in Example 1 and the results were shown in Table 6.

TABLE 6

| Recording sheet | Void-forming interlayer | Transferred amount by Bristow Test $Q_1$ (ml/m$^2$) | Cobb absorptiveness value $Q_2$ (g/m$^2$) | $Q_1/Q_2$ | Glossiness | Cockling | Bleeding resistance | Maximum density Y | Maximum density M | Maximum density C | Image quality |
|---|---|---|---|---|---|---|---|---|---|---|---|
| 101 (Inv.) | No | 25 | 42 | 0.60 | 22 | B | B | 1.72 | 1.92 | 2.05 | B |
| 108 (Comp.) | No | 19 | 24 | 0.79 | 21 | B | C | 1.65 | 1.85 | 1.94 | C |
| 601 (Inv.) | Yes | 34 | 52 | 0.65 | 33 | A | A | 1.72 | 1.92 | 2.05 | A |
| 602 (Inv.) | Yes | 33 | 55 | 0.60 | 35 | A | A | 1.74 | 1.96 | 2.06 | A |
| 603 (Inv.) | Yes | 32 | 52 | 0.62 | 34 | A | A | 1.75 | 2.01 | 2.02 | A |

Inv.: Invention, Comp.: Comparison

As is demonstrated by Table 6, Recording Sheets 601 through 603, the ink absorptive layer of which was coated after coating the porous interlayer onto the water absorptive support, showed the desired effects of the present invention. Further, the properties of glossiness and cockling were improved, and image quality was superior to the comparative sample.

It was demonstrated that the present invention can provide a ink-jet recording sheet having properties of high ink absorbance, high cockling resistance, high bleeding resistance, high maximum density, and high image quality.

It was demonstrated that the technology of the present invention is able to provide a photo-grade ink-jet recording sheet having properties of high ink absorbance, high cockling resistance, high bleeding resistance, high maximum density, low cost as well as high image quality.

What is claimed is:

1. An ink-jet recording sheet, comprising:

(i) a support which is capable of absorbing water; and (ii) an ink absorptive layer, which has a void structure, including;

(a) a first hydrophilic binder; and (b) inorganic particles having an average diameter of 3 to 200 nm;

wherein the ink-jet recording sheet has a $Q_1$ value of 15 to 35, and a $Q_1/Q_2$ value of 0.3 to 0.7;

the $Q_1$ value being a Bristow Test value (ml/m$^2$) which is derived from a first transferred amount of a mixture solution of diethylene glycol/trietylene glycol monobutylether/water, at a respective weight ratio of 15:15:70, being in contact with a surface of the ink absorptive layer for 1.0 second; and the $Q_2$ being a Cobb value (g/m$^2$), and derived from a second transferred amount of the mixture solution in contact with the surface of the ink absorptive layer for 60 seconds.

2. The ink-jet recording sheet of claim 1 wherein an amount of the ink absorptive layer is 7 to 30 g/m$^2$.

3. The ink-jet recording sheet of claim 1 wherein the ink absorptive layer contains a cationic polymer or cationic particles.

4. The ink-jet recording sheet of claim 1, wherein the support includes a gelling agent which is capable of gelling a coating composition forming the ink absorptive layer.

5. The ink-jet recording sheet of claim 1, wherein the $Q_1$ value is 20 to 30 ml/m$^2$.

6. The ink-jet recording sheet of claim 5, wherein the ink absorptive layer includes a gelling agent which is capable of gelling the ink absorptive layer.

7. The ink-jet recording sheet of claim 6, wherein the gelling agent is boric acid or a salt of boric acid.

8. The ink-jet recording sheet of claim 6, wherein the amount of the gelling agent is 1 to 200 mg per gram of the first hydrophilic binder.

9. The ink-jet recording sheet of claim 1, wherein the norganic particles are at least one of silica, colloidal silica, calcium silicate, calcium carbonate, boehmite, aluminum hydroxide and hydrate of aluminum hydroxide.

10. The ink-jet recording sheet of claim 9, wherein the norganic particles are silica.

11. The ink-jet recording sheet of claim 9, wherein the hydrophilic binder is polyvinyl alcohol and the ink absorptive layer further contains a gelling agent.

12. The ink-jet recording sheet of claim 11 which further comprises an interlayer including a second hydrophilic binder between the support and the ink absorptive layer, wherein the weight ratio of the inorganic particles to the first hydrophilic binder is not less than 3, and the gelling agent is boric acid or a salt of boric acid whose amount is 1 to 200 mg per gram of the first hydrophilic binder.

13. The ink-jet recording sheet of claim 1, wherein the hydrophilic binder is polyvinyl alcohol.

14. The ink-jet recording sheet of claim 1, wherein the weight ratio of the inorganic particles to the first hydrophilic binder is not less than 3.

15. The ink-jet recording sheet of claim 1 which further comprises an interlayer including a second hydrophilic binder between the support and the ink absorptive layer.

16. The ink-jet recording sheet of claim 13, wherein the interlayer has a void structure containing particles of an average diameter of 3 to 1000 nm.

17. The ink-jet recording sheet of claim 16, wherein the inorganic particles are colloidal silica.

18. The ink-jet recording sheet of claim 15, wherein the amount of the second hydrophilic binder is 0.01 to 5 $g/m^2$.

19. The ink-jet recording sheet of claim 18, wherein the second hydrophilic binder is gelatin or polyvinyl alcohol.

20. A multi-layered ink-jet recording sheet, comprising:

(i) a support which is capable of absorbing water;

(ii) an ink absorptive layer which has a void structure including;

(a) a first hydrophilic binder; and (b) inorganic particles having an average diameter of 3 to 200 nm; and (iii) an interlayer between the support and the ink absorptive layer, which contains a second hydrophilic binder;

wherein the ink-jet recording sheet has a $Q_1$ value of 15 to 35, and a $Q_1/Q_2$ value of 0.3 to 0.7;

the $Q_1$ value being a Bristow Test value ($ml/m^2$) which is derived from a first transferred amount of a mixture solution of diethylene glycol/trietylene glycol monobutylether/water, at a respective weight ratio of 15:15:70, being in contact with a surface of the ink absorptive layer for 1.0 second; while the $Q_2$ being a Cobb value ($g/m^2$), and derived from a second transferred amount of the mixture solution in contact with the surface of the ink absorptive layer for 60 seconds.

21. The ink-jet recording sheet of claim 1, comprising an interlayer containing boric acid or a salt of boric acid between the support and the absorptive layer.

22. The ink-jet recording sheet of claim 1, comprising an interlayer between the support and the ink absorptive layer, wherein the interlayer contains a self-cross linking resin or a colloidal silica composite.

* * * * *